US007229485B2

(12) United States Patent
Tanner-Jones

(10) Patent No.: US 7,229,485 B2
(45) Date of Patent: Jun. 12, 2007

(54) PLASMA REDUCTION PROCESSING OF MATERIALS

(75) Inventor: Jeffrey Tanner-Jones, Gwynneville (AU)

(73) Assignee: Tesla Group Holdings Pty Limited (AU)

( * ) Notice: Subject to any disclaimer, the term of this patent is extended or adjusted under 35 U.S.C. 154(b) by 140 days.

(21) Appl. No.: 10/433,356

(22) PCT Filed: Dec. 4, 2001

(86) PCT No.: PCT/AU01/01569

§ 371 (c)(1),
(2), (4) Date: Jul. 21, 2003

(87) PCT Pub. No.: WO02/46482

PCT Pub. Date: Jun. 13, 2002

(65) Prior Publication Data

US 2004/0060387 A1 Apr. 1, 2004

(30) Foreign Application Priority Data

Dec. 4, 2000 (AU) ..... PR 1862

(51) Int. Cl.
*B22F 9/14* (2006.01)

(52) U.S. Cl. ..... 75/346

(58) Field of Classification Search ..... 75/346
See application file for complete search history.

(56) References Cited

U.S. PATENT DOCUMENTS 4,311,520 A 1/1982 Kruesi
4,361,441 A 11/1982 Tylko et al.
4,394,162 A * 7/1983 Tylko ..... 74/10.19
4,501,717 A 2/1985 Tsukamoto et al.
4,753,675 A * 6/1988 Ovshinsky et al. ..... 148/105
5,085,885 A * 2/1992 Foley et al. ..... 427/575

(Continued)

FOREIGN PATENT DOCUMENTS

JP 55-149642 A 11/1980
WO WO 89/04379 5/1989

OTHER PUBLICATIONS

Bullard, D.E., et al., ""Non-Equilibrium Plasma Processing of Ores" in Thermal Plasma Applications in Materials and Metallurgical Processing" 1992, TMS, Warrendale, PA, XP009053927, pp. 175-191.

Wan J.K.S et al., "High-Power Pulsed RF Decomposition of Ore Samples with a Carbon Source," Journal of Microwave Power and Electromagnetic Energy, The Institute, Vienna, VA, US, vol. 31, No. 1, 1996, pp. 54-58, XP009007396.

(Continued)

*Primary Examiner*—George P. Wyszomierski
(74) *Attorney, Agent, or Firm*—Woodard, Emhardt, Moriarty, McNett & Henry LLP

(57) ABSTRACT

In a process for the reduction of a metalliferous ore or concentrate the ore or concentrate is first prepared into a particulate form. A reaction chamber (3, 103, 203, 301, 401, 503, 603, 702) is then charged with ore or concentrate, a reductant and an input gas. The reaction chamber (3, 103, 203, 301, 401, 503, 603, 702) is irradiated with electromagnetic radiation within a frequency range of 30 MHz to 300 GHz until a non-equilibrium plasma is initiated. The plasma is sustained and controlled with the radiation until the ore or concentrate is reduced to form reduction product.

36 Claims, 11 Drawing Sheets

U.S. PATENT DOCUMENTS

| | | | | |
|---|---|---|---|---|
| 5,282,880 | A | 2/1994 | Olson | |
| 6,277,168 | B1 | 8/2001 | Huang et al. | |
| 6,379,419 | B1 * | 4/2002 | Celik et al. | 75/346 |
| 6,409,851 | B1 * | 6/2002 | Sethuram et al. | 148/565 |
| 6,689,192 | B1 * | 2/2004 | Phillips et al. | 75/342 |
| 2002/0144535 | A1 * | 10/2002 | Sakata et al. | 73/1.03 |

OTHER PUBLICATIONS

Your, R.M. et al., Generation and Behavior of Fine Particles in Thermal Plasmas-a review: Plasma Chemistry and Plasma Processing, Plenum Press, New York, US, vol. 5, No. 1, Mar. 1985, pp. 1-37, XP002123724.

* cited by examiner

PLASMA REDUCTION PROCESSING OF MATERIALS

FIELD OF THE INVENTION

The present invention relates to the chemical processing of materials in a plasma environment, and in particular relates to pyrometallurgical reduction processes in a plasma environment.

BACKGROUND OF THE INVENTION

The pyrometallurgical reduction of metalliferous ores and concentrates typically involves the heating of the ore or concentrate in a smelting furnace with a reductant to a temperature which generally melts the ore and at which chemical reaction of the ore/concentrate with the reductant reduces the ore/concentrate into metallic product or higher end-value product with a lower oxidation state. Large amounts of energy are required to initiate and sustain reduction processes in such smelting finances, and the recovery rate of metallic product often renders such operations commercially unviable. The non-reduced components of the ore/concentrate form a slag, which often contains valuable metallic content. Recovery of the metallic content from such slags is, however, again often commercially unfeasible by conventional methods.

Microwave radiation has been utilised in various industrial applications for the application of energy to heat materials, including the microwave heating of chemical reactants to kinetically and thermodynamically stimulate the same for the initiation of chemical reactions. Microwave treatment of metalliferous ores and other comparable materials has been utilised as an augmentative precursor treatment, applying energy to the ore to thermodynamically stimulate the same and prepare it for conventional recovery techniques such as conventional pyrometallurgical reduction, leaching or hydrometallurgical recovery processes.

OBJECT OF THE INVENTION

It is the object of the present invention to provide an improved pyrometallurgical reduction process.

SUMMARY OF THE INVENTION

In a broad form the present invention provides a process for the reduction of a metalliferous ore or concentrate comprising the steps of:

- preparing said ore or concentrate into a particulate form;
- charging a reaction chamber with said ore or concentrate, a reductant and an input gas;
- irradiating said reaction chamber with electromagnetic radiation within a frequency range of 30 MHz to 300 GHz until a non-equilibrium plasma is initiated, and
- sustaining and controlling said non-equilibrium plasma with said radiation until said ore or concentrate is reduced to form reduction product.

Typically, pressure within said reaction chamber is maintained below 300 kPa during irradiation thereof.

Typically, said pressure is also maintained above 40 kPa.

In several embodiments, said pressure is maintained at about atmospheric pressure.

Said plasma may be initiated in said input gas.

Alternatively or additionally, at least part of said input gas may be decomposed during said irradiation, said plasma being initiated at least in part in the decomposed product of said input gas.

The reductant will typically comprise a carbonaceous material.

The reductant may include a particulate carbonaceous material blended with said ore or concentrate.

The reductant may include carbon monoxide gas, said input gas including said carbon monoxide gas, said plasma being initiated at least in part in said carbon monoxide gas.

The reductant may comprise carbon monoxide gas and a particulate carbonaceous material.

Alternatively, the reductant may comprise a reactive metal.

The input gas may include an inert gas.

The inert gas may comprise argon or nitrogen.

The input gas may comprise air.

The reductant may include methane.

Preferably, said radiation is microwave radiation.

The ore or concentrate may be a concentrate derived directly from mined ore.

Alternatively the ore or concentrate may be a non-ore derived concentrate. Said non-ore concentrate may be a residue derived, waste derived or mining derived concentrate, such as from mine tailings or concentrator residue.

The ore or concentrate may be a concentrate in the form of a residue, such as a slag, slurry or slime, derived from metallurgical processing operations. Such residue may be derived from pyrometallurgical, hydrometallurgical, chemometallurgocal or electrometallurigeal processing stages during primary, secondary and/or tertiary stages of metallurgical processing operations.

The reaction chamber may be in the form of a fluidised bed reactor.

The reaction chamber may alternatively be in the form of an oven, said ore or concentrate being charged into a crucible placed within said oven.

The reaction chamber may be in the form of a rotary kiln reactor.

The reaction chamber may be in the form of a cyclone reactor.

The reaction chamber may be in the form of a conveyor fed reactor.

In such a conveyor fed reactor, said ore or concentrate is preferably prepared into a pelletised particulate form.

Preferably, said reduction product is of metallic form.

Said metallic reaction product may be in the form of a fume, said fume being extracted from said reaction chamber and separated from gases produced during said reduction.

Alternatively, said reduction product is a compound of reduced oxidation state.

The reduction product may be formed by reduction of said ore or concentrate through a series of subsequent reduction reactions.

The process may include the step of generating carbon monoxide, said plasma being initiated and sustained at least in part in said carbon monoxide.

When said input gas includes air and said reductant includes particulate carbonaceous material, said carbon monoxide may be generated from reaction of oxygen within said air with said particulate carbonaceous material.

Alternatively or additionally, when said reductant includes particulate carbonaceous material, said carbon monoxide may be generated from reaction of carbon dioxide produced during said reduction with said particulate carbonaceous material.

Alternatively or additionally, particulate carbonaceous material may be introduced into said reaction chamber after initiation of said plasma, said carbon monoxide being generated from reaction of carbon dioxide produced during said reduction, and/or oxygen within said air when said input gas includes air, with said introduced particulate carbonaceous material.

Preferably, said ore or concentrate is enveloped in a non-oxidising or inert gas environment during said reduction and during cooling of said reduction product following irradiation of said reaction chamber.

Preferably, said non-oxidising or inert gas is introduced to said reaction chamber during said cooling.

In one embodiment, said input gas is passed through said ore or concentrate during said irradiating step.

Preferably, said input gas is blasted upwardly through said ore or concentrate.

Preferably, said input gas is preheated prior to charging into said reaction chamber.

It has been a commonly held view that the generation of plasmas during the microwave chemical processing of materials, and in particular during the pyrometallurgical reduction of metalliferous ores and concentrates, is detrimental to the process system hardware and monitoring and control diagnostics equipment, and accordingly it is typical for such processes to be controlled in a manner to explicitly avoid the generation of a plasma.

Reaction rates, however, can increase by one or more orders of magnitude under plasma processing. A plasma is a mixture of excited molecules, atoms, ions, electrons and recombined particles in a ground state host gas. With the high particle energies which are characteristic of such plasma components, the physical and chemical behaviour of these component particles differs markedly from equivalent particles in the "ground state".

In pyrometallurgical processes conducted in a plasma environment, there is a predominance of reaction chemistry occurring at the plasma-solid or plasma-liquid interface. Whilst this feature is characteristic of pyrometallurgical processes in general, reaction rates across these interfaces are greatly enhanced by plasma chemistry, with an abundance of highly energised reactive species.

Plasmas initiated and sustained at "high" pressures exhibit an approximate equivalence of temperature between electrons and heavy particles (ions, atoms, excited molecules). Accordingly these plasmas are termed equilibrium plasmas, as there is (approximate) thermal equilibrium between particles. This is exhibited particularly at higher pressures as the high density of particles provides an increased frequency of collision between particles distributing energy relatively evenly between particles, providing a consistent bulk temperature throughout the particle species of the plasma. Because of the high-energy densities (thermal mass), equilibrium plasmas have commonly been utilised as precursor methods in material processing for their capability to heat, sinter, melt or vaporise solid materials. These are all essentially physical processes merely taking advantage of the physical thermal kinetics (properties) of the equilibrium plasma.

Non-equilibrium plasmas, which are more characteristic of low pressure environments, are characterised by particle temperature non-equivalence, with the "temperature" of electrons far exceeding that of the temperatures of the heavier particles. FIG. 1 depicts the separation of electron and heavy particle temperatures at low pressures, both with conventional plasmas and plasmas stimulated by microwave (or RF) radiation. It can be seen that at higher pressures, the electron and heavy particle temperatures merge. In a non-equilibrium plasma, the physical and chemical behaviour of the component particles may be profoundly different from that in the equivalent ground state environment. In a non-equilibrium plasma, with the various particle species moving with different energies, the measure of such energy, typically in the form of a "temperature" will vary greatly between species and between particles in each species population. This is evident when "temperature", a measure of thermal energy, is obtained by a mean reading by averaging-out the electron voltages (temperature equivalents) of particles having no adjustment for "thermal mass". Accordingly, the temperature of the plasma itself becomes meaningless as particle "temperatures" vary by perhaps four orders of magnitude, and "bulls" temperature measurements of plasma by different methods can disagree by an order of magnitude.

The processing effectiveness of low pressure, non-equilibrium plasmas is imbued by the reactivity of the chemically active species present rather than by the total energy available in the plasma This reactivity makes non-equilibrium plasmas more suited to systems reliant upon the chemical kinetics of the chemical reactions, as per that of the present application, than the equilibrium plasmas which have been used primarily in physical processes as discussed above.

The form of the diagram of FIG. 1 will be dependent upon various parameters, including the gas composition, ionising characteristics of the species present, and the form of energy applied to the system to generate the plasma. The pressure up to which a plasma will be of the non-equilibrium form will thus vary depending on these and other parameters.

Typical methods of producing plasmas are through ionisation by heating (thermal stimulation), ionisation by irradiation, and ionising by electrical discharge. Whilst most plasma production methods will result in an equilibrium plasma at pressures up to around atmospheric pressure, it is believed that the generation of a plasma by irradiation, particularly in the RF and microwave frequency ranges between 30 MHz and 300 GHz, pushes the graph of FIG. 1 to the right as depicted, such that non-equilibrium plasmas can be generated and sustained at operationally important pressures around atmospheric (101.4 kPa) and up to about three atmospheres (about 300 kPa) under sufficient applied energy, appropriate available species (chemistry) and at responsive radiation frequencies.

This is believed to be as a result of the microwave radiation applying energy to the dieletrically disparate particles of the plasma, in particular to the electrons. At frequencies within the RF and microwave frequencies, only the electrons in the ionised field can follow the oscillations of the electric field applied. As a result the electrons become more highly energised that the heavier particles of the plasma, such that the RF/microwave plasmas can generally be defined as non-equilibrium plasmas. Such RF/microwave plasmas can be induced and operated over a large pressure range, from below 0.1 kPa (for operations outside the main interest of the present invention), to pressures in excess of 300 kPa.

When a microwave field is applied across a gas, charged particles in that gas are accelerated. Because the mass of electrons is much much less than that of the heavier ion, atom and molecule particles, the action of the field is primarily to give energy to the electrons. Accordingly, electron temperatures can be in the extremely high range of tens of thousands of kelvin whereas the apparent bulk temperature of the plasma (primarily determined by the heavier particles) is orders of magnitude lower.

Reaction rates are generally governed by the mass transport diffusion of reactants, which is greatly enhanced by dielectric heating mechanisms during RF/microwave processing, typically in the presence of an RF/microwave stimulated plasma which, by definition, will have a high population of reactive species.

Plasma processing utilising RF/microwave stimulation also enables a great degree of control over the process, with the microwave radiation able to be directed to the reactant charge, in such a way as to envelope the entire reactant charge within the reaction chamber or to occupy a zone discretely within the charge. In continuous processing systems, residence time and thermochemical parameters can effectively be controlled through control of the applied radiation, providing superior processing or reduction results.

Whilst lower pressures well below atmospheric pressures ensure generation of an unambiguously non-equilibrium plasma with a large disparity between the temperatures of the electron and heavier particles, if the pressure in the reaction chamber is too low, then the density of reactive species to carry out the chemical processing will be too low for economically viable processing. Accordingly, it is preferred that the pressure of the reaction chamber in which the plasma is initiated and sustained is greater than 40 kPa.

The inherent advantage of the non-equilibrium plasma chemistry (ionisation chemistry) of non-equilibrium plasmas when utilised in chemical and metallurgical applications is that these plasmas can provide particles with the high energy required to stimulate and complete chemical reactions at high kinetic rates. For the range of applications relevant to the present application, high rates of mass transfer are desired with the high kinetic rate. Therefore, commercially viable productivity levels are often not achievable at extremely low pressures which provide extremely low rates of mass transfer.

Conversely, the advantage of processing certain reactions under non-equilibrium plasma conditions, despite low mass transfer rates, is that in the low density plasma environment, the high energy free electrons and ionised particles experience a greatly increased mean free path before collision and re-combination, imparting greatly increased energy to re-combination chemistry. This increased energy at possible reaction sites enables the activation energy requirement to be met for reactions which require extremely high energy input to proceed. Consequently, certain thermodynamically demanding metallurgical and chemical reactions can be carried out efficiently, if slowly, or if at all, by utilising the extremely high energy particles at low pressures.

Processes which require protection from re-oxidation reactions benefit from the protection implied by removal of potential oxidation sources by initial and continuing evacuation of oxidising agents, such as the common reduction reaction product carbon dioxide, from the reaction environment. This can be achieved by maintaining the process at low pressures, continually evacuating the reaction chamber. Alternatively, or additionally, such carbon dioxide can be converted to the reductant carbon monoxide with fine carbon in the reaction chamber at elevated temperatures.

BRIEF DESCRIPTION OF THE DRAWINGS

Preferred forms of the present invention will now be described by way of example with reference to the accompanying drawings wherein:

FIG. 5(*b*) is an enlarged fragmentary view of the top portion of the reaction chamber of FIG. 5(*a*).

FIG. 5(*c*) is a fragmentary cross sectional view of the gas generation system associated with the reaction chamber of FIG. 5(*a*).

FIG. 5(*d*) is a cross sectional view of the reaction chamber of FIG. 5(*a*) taken through section 5—5.

FIG. 9(*b*) is a cross sectional view of the reaction chamber of FIG. 9(*a*) taken through section 9B—9B.

FIG. 9(*c*) is a cross sectional view of the reaction chamber of FIG. 9(*a*) taken through section 9C—9C.

DETAILED DESCRIPTION OF THE PREFERRED EMBODIMENTS

EXAMPLE 1

This example details a process to reduce monazite [(Ce, La,Th) $PO_4$], using an incrucible batch reduction process, to eradicate the phosphorus (of the phosphate) and concentrate the reduced heavy metals into one metallic or carbide product. With the phosphorus removed, the reaction product heavy metal (carbide) concentrate is suitable for further extractive processing in a halogenation, fractional distillation then dissociation route. The monazite used in this example contained La;Ce;Th; in approximate atomic ratio of 3:1:1. Other phosphate minerals have also been processed in a similar manner with comparable outcomes. The apparatus utilised to carry out the process of this example is depicted in FIG. 2.

Firstly, the monazite concentrate, which had been derived form mineral sands, was prepared in a particulate form by milling to a grain size of less than 10 micrometers, and intimately blended with a 10 percent stoichiometric excess of a reductant in the form of fine pure carbon. The fine blend increases the available reaction interface area.

Figure 1:
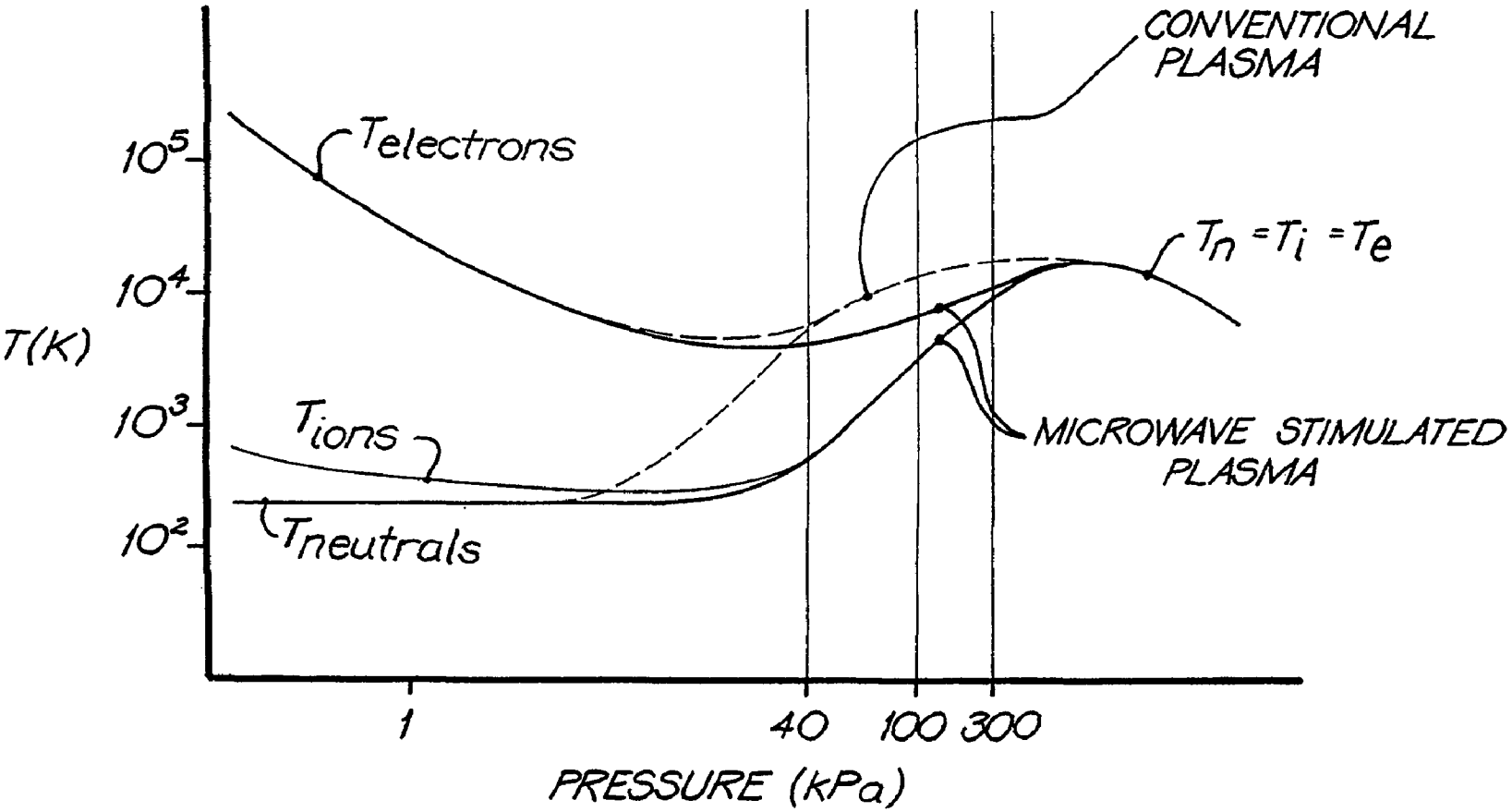
FIG. 1 is a diagram showing the separation of electron and heavy particle temperatures in a plasma at varying pressures.
Figure 2:
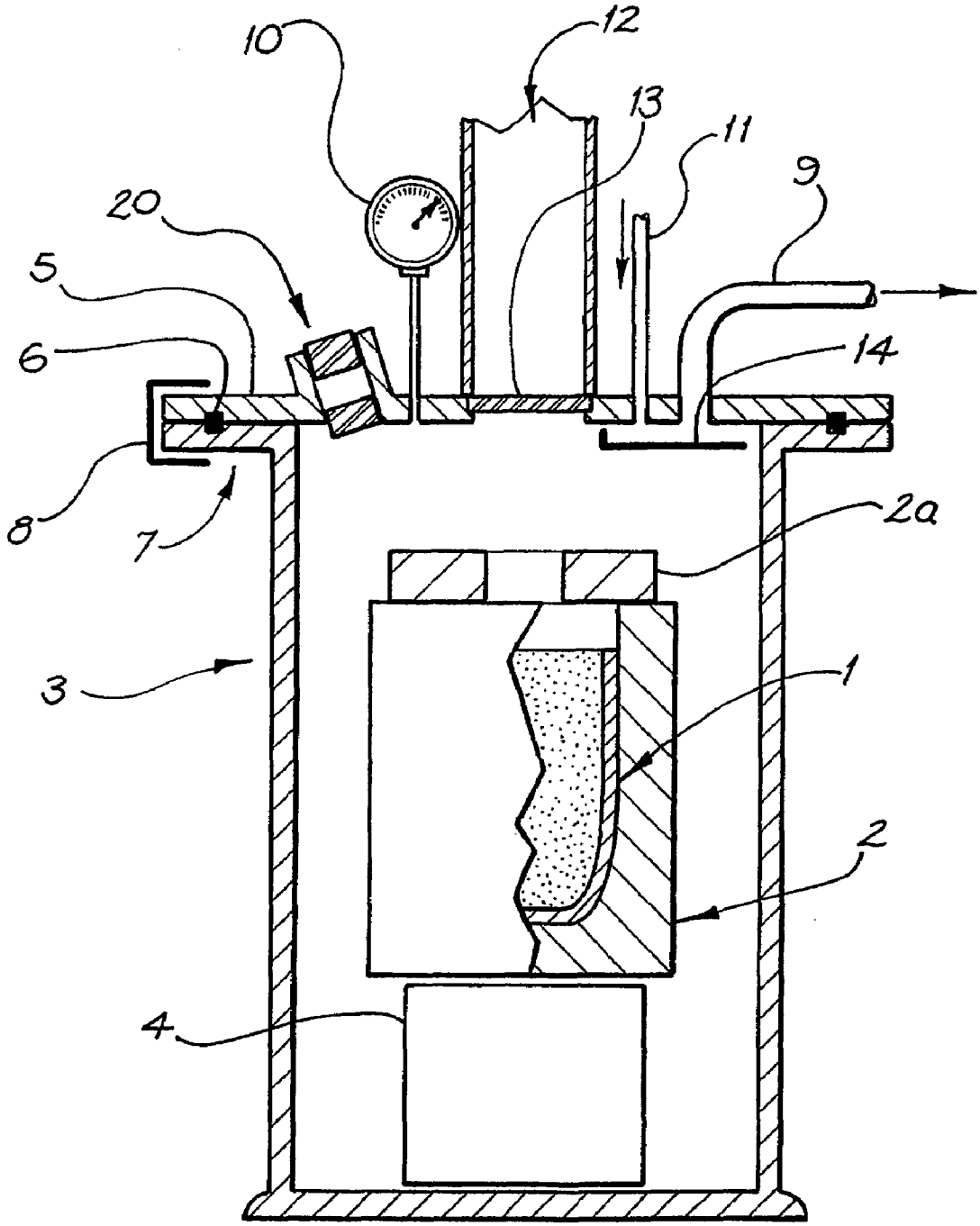
FIG. 2 is a partially cross sectioned view of a reaction chamber used in the process of Example 1.

100 grams of the blended monazite and carbon was charged into a low density alumina crucible 1 (see FIG. 2). The crucible 1, being formed of low density alumina is microwave transparent. The monazite/carbon blend was charged loosely into the crucible 1 without packing to maximise its permeability.

A microwave transparent aluminium silicate based fibre-mat insulation wrap 2 covered the exterior of the crucible, insulating the same so as to maintain heat within the crucible 1. A partially open insulation lid 2*a* was placed over the opening of the crucible to insulate the same whilst allowing for the escape of gases and observation of the crucible contents. The insulation wrapped crucible 1 was then placed in a reaction chamber 3, in the form of a purpose-built evacuable reaction chamber capable of operation from an effectively "full" vacuum of less than 0.1 kPa to 1000 kPa (approximately ten atmospheres). The crucible 1 was placed on a microwave transparent refractory brick spacer 4 so as to position the monazite/carbon blend load toward the centre of the reaction chamber 3 so as to optimise its location within the applied microwave field and thereby optimise its load potential.

The reaction chamber 3 was then sealed with a lid 5. An o-ring 6 with the addition of vacuum grease was used to seal the joint between the reaction chamber upper flange 7 and the lid 5. The flange 7 and lid 5 were then externally clamped utilising a suitable clamp 8. A viewing port 20 was provided in the lid to enable visual monitoring of the process.

The sealed reaction chamber 3 was then evacuated via reaction chamber outlet 9 utilising a suitable vacuum pump. The reaction chamber 3 was evacuated to the system dependant pump limit of less than 1 kPa, as monitored on a vacuum gauge 10. The reaction chamber 3 was then charged for two minutes with high purity argon gas via gas inlet 11. The evacuation/charge cycle was then repeated three times to ensure substantially all air within the reaction chamber had been replaced with the argon gas. Removing the air ensured all oxygen had been removed from the reaction chamber, leaving an inert atmosphere protecting reduction product from re-oxidation.

The argon supply was then turned off, and the reaction chamber 3 evacuated to a minimum pressure of 40 kPa for the reduction operation, again with the system pressure being monitored via the vacuum gauge 10 for stability over a 5 minute period.

The reaction chamber was then irradiated with microwave radiation, with a power of 1 kW and a frequency of 2450 MHz, via a top-mounted wave guide 12. The wave guide 12 was arranged with a microwave transparent ceramic window 13, formed of alumina, at the interface with the reaction chamber 3 to seal the same and to insulate against radiant heat.

The remnant argon gas (at 40 kPa) in the largely evacuated reaction chamber 3 was the ideal environment for the stimulation of a non-equilibrium plasma capable of initiating the initial solid state reduction of the monazite utilising the carbon as reductant, producing carbon monoxide (CO) as a by-product of this initial solid state reduction. This initial solid state reduction can be represented by Equation 1(a) below:

$$(Ce,La,Th)PO_4+4C \Rightarrow (Ce,La,Th)OC+P+3CO\Uparrow \qquad 1(a)$$

The CO produced in the above solid state reduction itself becomes an effective reductant, transferring carbon in a gaseous form to the reaction interface with greater efficiency. Significantly also for the kinetics of the reaction, the gaseous CO ionises in the microwave stimulated environment to augment the plasma and provide highly active positive ion species (principally $CO^+$) which are not present in the original argon plasma. Whilst the argon plasma exhibits highly energetic negative (including electrons), positive, re-combined and excited species, it provides no reactive radical species. The ionisation of the CO and the gaseous phase reduction of the monazite can be represented by equations 1(b) and 1(c) below:

$$CO \Rightarrow CO^+ + e \qquad 1(b)$$

$$(Ce,La,Th)PO_4+3CO \Rightarrow (Ce,La,Th)OC+P+3CO_2\Uparrow \qquad 1(c)$$

The CO in Equation 1(c) may be in the ionised form $CO^+$.

A further final reduction step from the oxycarbide to a (complex) metal carbide was exhibited, again using the CO (at least partly ionised) as reductant. The following Equation 1(d) can be used to reasonably explain this final step of the reduction process:

$$x(Ce,La,Th)OC+yCO \Rightarrow (Ce,La,Th)_xC_Y+ nCO_2\Uparrow+mCO\Uparrow \qquad 1(d)$$

Again the CO in Equation 1 (d) may be in the ionised form $CO^+$.

Whilst this reduction to the carbide was confirmed through analysis, the very hot carbide showed a propensity to strip oxygen from the otherwise very stable oxide crucible (and other refractory material in contact) and return much of the carbide product material to the more stable oxycarbide phase(s).

During the above reduction reactions, gases produced were drawn away and pumped from the chamber via the outlet 9 during ongoing evacuation of the reaction chamber 3 such that the reaction chamber pressure always remained below 50 kPa (absolute). With this low pressure having been maintained throughout the process, the plasma sustained can be well assumed to have remained well within non-equilibrium conditions.

The microwave radiation sustaining the plasma and the reduction reactions was continued until the distinctive CO plasma colour could no longer be visually detected at the same intensity. This change in plasma colour and intensity suggests that CO was no longer being produced, indicating that reduction had finished, along with an associated reduction in pressure back down to the pump limit. At this stage the plasma is expected to have been a principally CO plasma, with the argon having largely been flushed through the system during the constant evacuation through the reaction chamber outlet 9.

One minute beyond this visually assessed point of reduced CO plasma colour and intensity discussed above, and about 10 minutes after plasma inception, the microwave power was shut off. Argon was bled into the still evacuating chamber via the gas inlet 11, and the pressure stabilised at 20 kPa (absolute) for one hour (to include principal cooling through solidification). The vacuum pump was then disengaged and the reaction chamber 3 sealed from the pump and backfled with high purity argon to a modest positive pressure and kept thus until fully cooled before opening on the following day.

The reactor chamber 3 was slowly brought to atmospheric pressure, carefully opened so that no reaction product was disturbed, dislodged nor contaminated, and the crucible 1 removed from the chamber 3. The crucible 1 contained the reduced heavy metals carbide (oxycarbide) product, with ash and gangue slag atop. The heavy metals content of the crucible 1 was scraped from the crucible wall and kept for analysis and further processing as desired.

The metal reaction chamber wall 1 and metallic solidification baffles 14, which protect the reaction chamber outlet 9 (forming the vacuum pump inlet) by collecting condensate of the hot vapour phases before they escape through the outlet 9, were copiously coated in "fluffy" labile phosphorous. The recovered phosphorus was analysed as pure, elemental phosphorous as anticipated by Equations 1(a) to 1(d). The reactor components were then cleaned of reaction products in preparation for further batch processing.

EXAMPLE 2

This example details a process to economically recover metals of value from metallurgical wastes and slags using an in-crucible batch reduction process. Zinc was recovered from a zinc-bearing slag by reducing the metal in situ in the slag and recovering the metal as metallic fume from the hot reacting bed. The zinc fume may, at this point, be re-oxidised to a refined grade of zinc oxide powder, or reacted with a halogen to yield a zinc halide. In the context of this specification, a fume is to be understood as including a metallic vapour or a metallic oxide, metallic halide or other similar vapour derived from the metallic vapour.

The process was performed successfully at atmospheric pressure, in a gas mix of nitrogen and carbon monoxide, as opposed to the reduced pressure of Example 1. As metals such as zinc are less of an "oxygen getter" than the "reactive metals" (such as the La, Ce and Th of the reduced solid product phase of Example 1), the reduced zinc product of the present Example had a lesser tendency to re-oxidise, and hence required less protection against re-oxidation. Consequently, the process could be carried out successfully at atmospheric pressure as the propensity of the reduced product to re-oxidise was overwhelmed by the reducing conditions in the reaction environment of the reaction chamber. The desired fume product (metal, oxide or halide) dictated the composition of, and the related chemical possibilities for, the reaction chamber environment in which the zinc was reduced and fumed. In the present example, process efficiency and product quality were able to be maintained by generating and sustaining a non-equilibrium plasma at atmospheric pressure, and hence the difficulty and expense of obtaining and controlling a reduced pressure reaction chamber environment were avoided.

Figure 3:
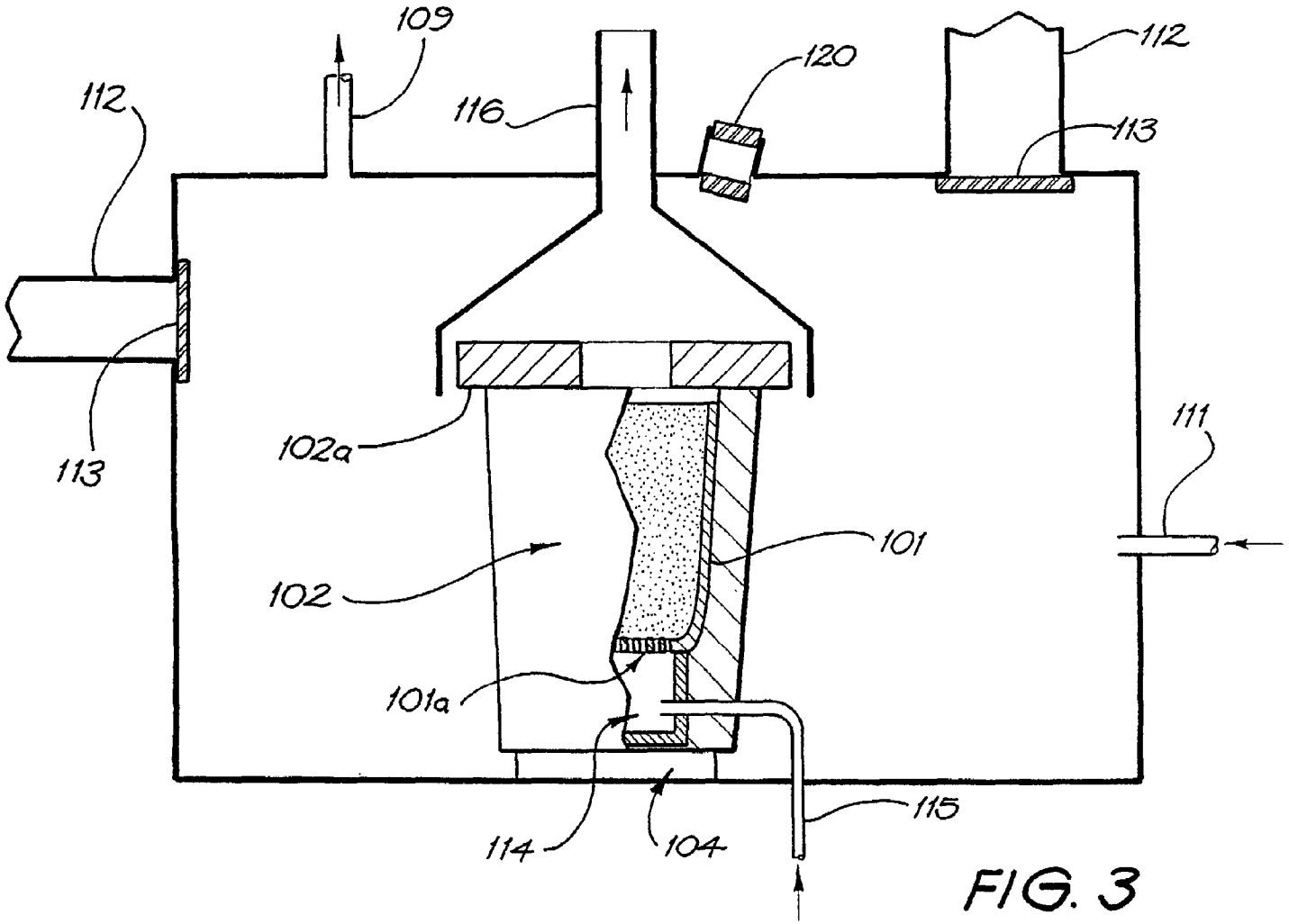
FIG. 3 is a partially cross sectioned view of a reaction chamber used in the process of Example 2.

The apparatus utilised to carry out the process of this example is depicted in FIG. 3.

Zinc-bearing metallurgical slag material having a mineralogical content of zinc oxide (ZnO), or a more complex mineralogy with ZnO-equivalent, was ground into particulate form to a grain size of less than 500 micrometers and blended, to twice the stoichiometric requirement (with respect to the ZnO), with a reductant in the form of fine reactive charcoal.

100 grams of the blend was charged into an alumina crucible 101. The charge was loosely packed to maximise the permeability thereof. The base of the crucible 101 was configured with fine passages 101*a* passing therethrough rendering the base porous to allow an updraught of gases through the loosely packed charge of slag and charcoal. The crucible was mounted on a rigid ceramic box 114 having an open top communicating with the passages 101*a* of the crucible base. The crucible 101 and box 114 were insulated with a microwave transparent aluminosilicate based fibre-mat wrap 102 to insulate the crucible 101 from heat loss. The insulated crucible 101 and box 104 were then placed into a reaction chamber 103, in the form of a purpose modified commercially available 1300W microwave oven. The crucible/box arrangement was placed on a suitable refractory brick spacer 104 to locate the charge toward the centre of the reaction chamber 103, and hence favourably placed within the applied microwave field. The opening of the crucible 101 was partly covered by a loose, microwave transparent insulation lid 102*a* to allow the escape of fume reaction product whilst maintaining much of the heat within the crucible 101. A viewing port 120 in the roof of the reaction chamber 103 allowed for visual monitoring of the reaction process.

The reaction chamber 103 was closed and then simultaneously evacuated via an outlet 109 by a roughing pump whilst nitrogen gas was bled into the chamber 103 via a primary gas inlet 111. After five minutes, the roughing pump was closed-off and the nitrogen supply was increased to a positive pressure to flush-out and fill the chamber 103.

The chamber 103 was not inherently airtight, and hence the pressure within the reaction chamber 103 remained at close to atmospheric pressure. After five minutes of flushing, the primary gas inlet 111 was closed. A reductant gas mixture of 20% CO in nitrogen was supplied at a low flow rate to the box 114 via a secondary gas inlet 115 communicating therewith through the bottom of the reaction chamber 103. The supply of reductant gas to the box 114, at a positive pressure, resulted in the reductant gas passing through the passages 101*a* in the base of the crucible 101 and permeating through the slag/charcoal charge.

The reaction chamber 103 was then irradiated with microwave radiation of frequency 2450 MHz and applied power of 1300 W, via two counterposed waveguides 112 sealed from the reaction chamber 103 by microwave transparent ceramic windows 113. After several minutes of irradiation, heating the slag/charcoal charge and gases within the reaction chamber, random thermal runaway in disparate, dielectrically disposed particles initiated the generation of a $CO/N_2$ plasma in and above the crucible 101 within the reaction chamber 103. This plasma could be observed through the shielded viewing port 120.

By operator interpretation of plasma extent and radiant heat intensity, microwave inadiation of the reaction chamber 103 was continued with the applied power being manually adjusted to provide apparent thermal constancy and to avoid overheating and failure of the crucible 101 by melting. From prior experience and the examination of, and knowledge of the melting points of phases present and from reaction thermochemistry data, it was estimated that the process was operated at "temperatures" equivalent to the range 900° C. to 950° C. As previously discussed, the concept of temperature in a dynamic thermal system such as a non-equilibrium plasma is relatively meaningless, and accordingly "temperature" measurement by thermocouple or direct line-of-sight pyrometry methods is impracticable and would provide almost meaningless information.

Approximately one to two minutes after plasma initiation, a metallic fume was readily detected rising from the plasma, indicating reduction of the zinc oxide content of is the slag. The solid and gaseous state reduction of the zinc oxide, utilising the charcoal and CO plasma as reductants respectively, can be represented by Equations 2(a) and 2(b) below:

$$ZnO+C \Rightarrow Zn+CO\Uparrow \quad 2(a)$$

$$ZnO+CO \Rightarrow Zn+Co_2\Uparrow \quad 2(b)$$

The CO in Equation 2(b) may be in the ionised form $CO^+$.

The metallic fume is particularly easy to visually detect if it has been allowed to reoxidise as it leaves the reducing atmosphere of the crucible 101, after having been separated from the slag by the reduction processes of Equations 2(a) and 2(b).

To produce a finely divided zinc oxide (ZnO) powder oxide, an oxygen ($O_2$) stream was introduced such that the reduced zinc metal vapour passed through the $O_2$ stream, rapidly converting it to a solid zinc oxide phase fume which could be easily collected. Whilst simply passing the zinc metal vapour through $CO_2$ already within the reaction chamber environment as a reduction by-product of Equation 3(b) also had the effect of oxidising the zinc vapour, this reaction is less spontaneous and resulted in some of the zinc fume remaining unconverted as solid zinc fume. To produce zinc chloride ($ZnCl_2$), $Cl_2$ gas can be introduced across the hot zinc vapour. The zinc chloride produced had to be cooled significantly before a solid fume product could be collected by precipitation onto a cool surface. The re-oxidation processes can be represented by Equations 2(c) to 2(e) below:

$$2Zn+O_2 \Rightarrow 2ZnO\Uparrow \quad 2(c)$$

$$Zn+CO_2 \Rightarrow ZnO+Co_2\Uparrow \quad 2(d)$$

$$Zn+Cl_2 \Rightarrow ZnCl_2\Uparrow \quad 2(e)$$

The fume product, in the form of metallic zinc, zinc oxide or a zinc halide dependant on system atmosphere, was extracted away through a microwave transparent borosilicate fume hood 116 placed over the crucible 101 by an extractor fan to a precipitation and bagging system, via a vacuum seal tap, where the fume was collected as solid fines.

Once the fuming had died away to a visually imperceptible quantity, the process was deemed to have finished and irradiation ceased. Completion of the process was later confirmed by analysis of the slag material remaining in the crucible.

Immediately after the irradiation had ceased, the contents of the crucible remain reactive and at a high temperature for a prolonged period, bleeding of the reducing $CO/N_2$ gas mixture through the crucible was continued until the charge cooled to about 200° C. Continued bleeding with nitrogen was then used to cool the system to ambient temperature.

EXAMPLE 3

Figure 4:
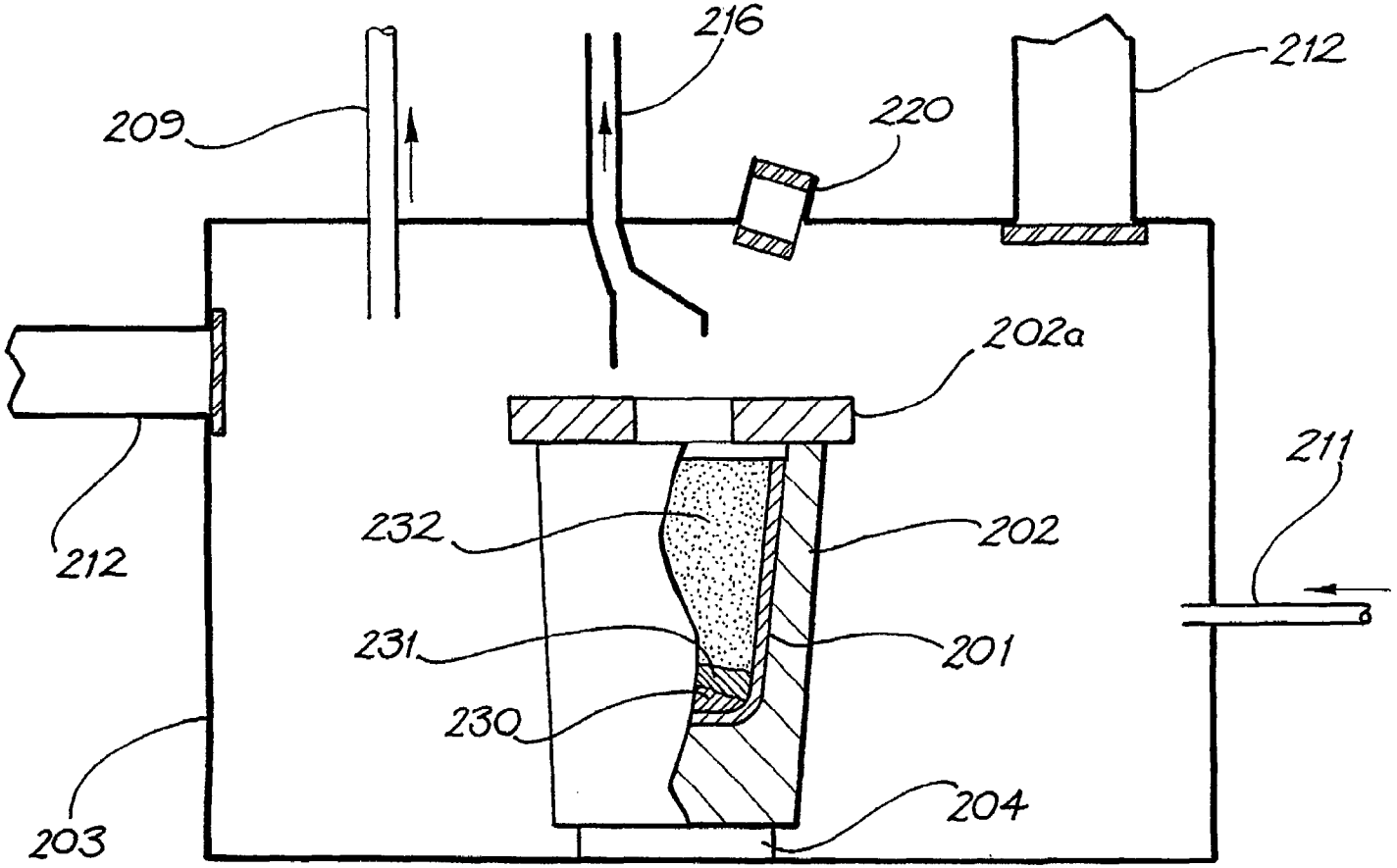
FIG. 4 is a partially cross sectioned view of a reaction chamber used in the process of Example 3.
Figure 5A:
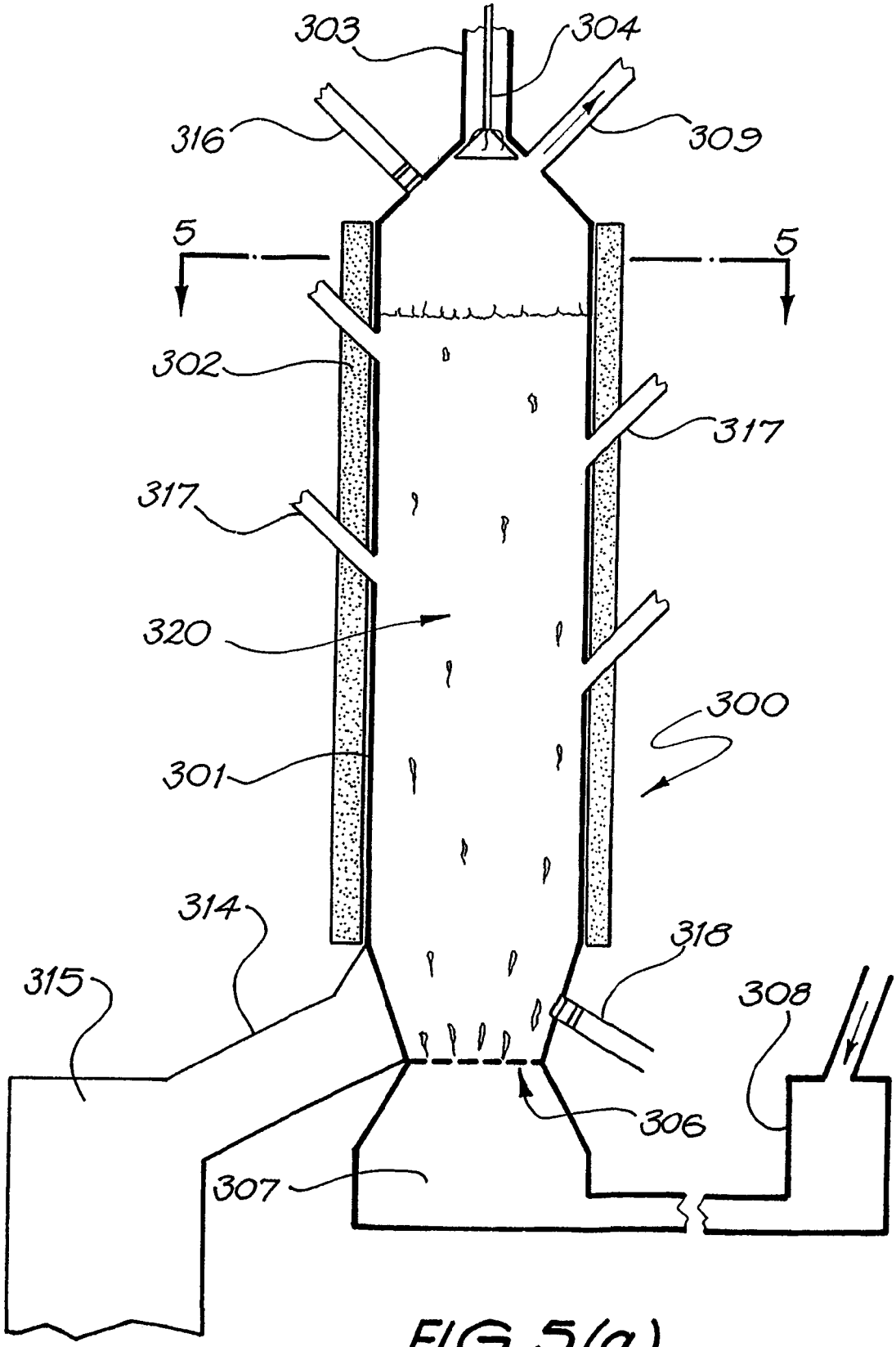
FIG. 5(*a*) is a partially cross sectioned view of a reaction chamber used in the process of Example 4.
Figure 5B:
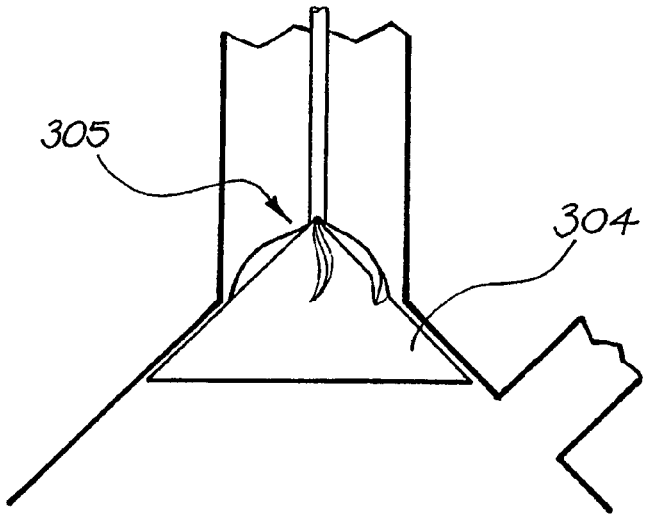
Figure 5C:
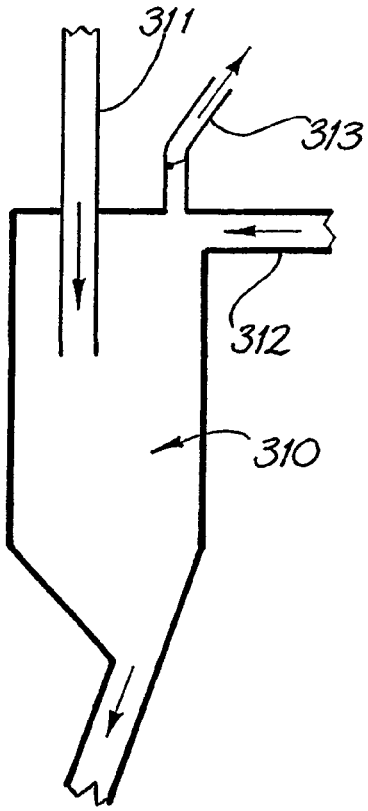
Figure 5D:
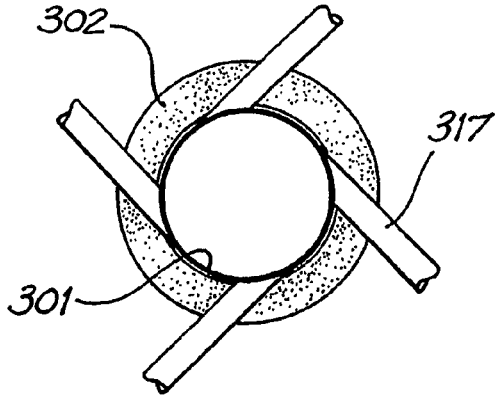

This example details a process to reduce chromite ($FeO.Cr_2O_3$) ore concentrate using an in-crucible batch reduction process resulting in a chromium iron alloy. The apparatus utilised to carry out the process of this example is depicted in FIG. 4.

The process was carried out at atmospheric pressure, which proved adequate for this example. Further, rather than charging the reaction chamber with a gas mixture of nitrogen and carbon monoxide as per Example 2, air (composed principally of $N_2$, $O_2$) was utilised as the initial gas in the reaction chamber. Combustion of char through heating and micro-arcing of the char in the oxygen rich environment to produce CO was sufficient to protect against re-oxidation of reaction product. Further, molten slag covers the reduced metallic product phases to confer further protection in this example, enabling the simpler and more economical processing option of an atmospheric pressure air environment.

High grade chromite ore concentrate was ring-milled with a reductant in the form of brown coal char in stoichiometric quantity to a grain size of less than 200 micrometers. The blend was loosely charged into a suitable microwave transparent oxide ceramic crucible 201, atop a bed of granular char to allow for pooling of liquid metal products beneath the reactants. A further layer of granular char was laid over the chromite/coal char blend charge to assist with protection from re-oxidation. As per Examples 1 and 2, the crucible 201 was insulated with an aluminosilicate fibre insulation wrap 202 and a lid 202*a* configured to allow limited observations through the viewing port 220 and allow gaseous reduction products to escape.

The insulated crucible 201 was placed into the reaction chamber 203, in the form of a modified commercial microwave oven on a ceramic brick 204, "charged" with air at atmospheric pressure. No flushing or evacuation was carried out.

The reaction chamber 203 was then irradiated with 2450 MHz microwave radiation at full 1300 W oven power via top and side mounted waveguides 212. The reactant charge in the crucible 201 heated rapidly due to micro-arcing between char particles and then between dielectrically different particles in the charge blend, leading to the onset of some chemical reactions of lower activation energy requirements. The release of energy from these initial exothermic reactions provided further thermal energy to further heat and activate reduction reactions.

The initial micro-arcing, in the applied microwave field, of the char in the oxygen containing air environment generated CO, according to Equation 3(a) below, providing protection against re-oxidation of subsequent reduction reaction product:

$$2C+O_2 \Rightarrow 2CO\Uparrow \qquad 3(a)$$

As the reactant charge increased in temperature, with massive deviations in local temperatures across a random temperature profile, a non-equilibrium nitrogen plasma was generated in the principally nitrogen (air) atmosphere of the reaction chamber 203, with heating subsequently becoming more even throughout the reactant charge. With the highest temperatures being established in and above the reactant charge within the crucible, the plasma was concentrated within the upper levels of the reactant charge (through plasma penetration of the static charge), and directly above the reactant charge within the crucible, 201 below the insulating lid 202*a*. The radiation, and the plasma, penetrate deeper into the static in-crucible charge with increased permeability of the charge.

The nitrogen plasma stimulated initiation of the solid state reduction of the chromite utilising the charcoal as initial direct reductant, producing carbon monoxide (CO) as a by-product of this solid state reduction and which ionises, contributing to the plasma chemistry. The reactions produce chromium metallic product, leaving a wustite (FeO) rich phase to be reduced in a second stage. This result may be explained by the greater microwave susceptibility of $Cr_2O_3$ than FeO (to heat in a microwave field). The initial solid state reduction of the chromite can be represented by Equation 3(b) below:

$$FeO.Cr_2O_3 \Rightarrow 3C \Rightarrow 2Cr+FeO+3CO\Uparrow \qquad 3(b)$$

The CO produced from Equations 3(a) and 3(b) is not thermodynamically stable below approximately 950° C. when in an environment containing oxygen, such as that of the present example, and, on cooling, tends to oxidise with the oxygen present in the air atmosphere to carbon dioxide ($CO_2$), according to Equation 3(c) below:

$$2CO+O_2 \Rightarrow 2CO_2\Uparrow \qquad 3(c)$$

With increasing temperature, however, at the "temperatures" experienced in the plasma, the inverse is generally true, with free oxygen and carbon dioxide gas molecules existing in the atmosphere of the reaction chamber 203 directly above the reactant charge being thermochemically predisposed towards conversion (with char) to carbon monoxide, according to Equations 3(d) and 3(e) below:

$$O_2+2C \Rightarrow 2CO\Uparrow \qquad 3(d)$$

$$CO_2+C \Rightarrow 2CO\Uparrow \qquad 3(e)$$

The CO produced by these reactions itself ionises in the microwave stimulated environment to augment the predominantly nitrogen plasma with highly energetic, reducing $CO^+$ ions. In the reaction chamber environment, the plasma enveloping the reactant charge at the higher reducing "temperatures" is accordingly composed primarily of $N_2$ and CO species. The plasma protects the charge from possible oxidation reactions to the plasma extremities, maintaining a blanket of high energy reducing ions over the charge providing a highly reductive environment. Such protection is provided for by the nature of plasmas, and particularly non-equilibrium plasmas, the "chemical emphasis" of which are to break bonds in a manner analogous to chemical reduction reactions (that is, opposite to chemical oxidation reactions where bonds are completed).

The shift in plasma chemistry with the generation of $CO^+$ ions could be visibly observed as a shift in the characteristic emission colour of the plasma and audibly detected by an associated shift in power drawn at the magnetrons where there is plasma initiation or step-augmentation.

The CO available in the ground, excited, ionised and recombined states becomes an effective reductant, transferring carbon to the reaction interface with the chromite particles, initiating a gaseous phase reduction of the chromite. At this stage the reduction rates increase to a maximum. The ionisation of the CO and the ionised gaseous phase reduction of the chromite can be represented by equations 3(f) and 3(g) below:

$$CO \Rightarrow CO^{+} + e^{-} \quad 3(f)$$

$$FeO.Cr_2O_3 + 3CO^{+} + 3e^{-} \Rightarrow 2Cr + FeO + 3CO_2 \Uparrow \quad 3(g)$$

As discussed above, the $CO_2$ produced will tend to CO (according to Equation 3(e)) at the high plasma "temperatures" experienced at this stage. The subsequent solid and gaseous state reduction of the wustite (FeO) product of Equations 3(b) and 3(g) to metallic iron can be represented by Equations 3(h) and 3(i) below:

$$FeO + C \Rightarrow Fe + CO \Uparrow \quad 3(h)$$

$$FeO + CO^{+} + e^{-} \Rightarrow Fe + CO_2 \Uparrow \quad 3(i)$$

Where desired, other initial reductant gas (typically CO) can be introduced preemptively to the reaction chamber 203 via the primary gas inlet 211 to assist the various reduction processes. This will provide a reductive gas environment in the reaction chamber from the onset rather than relying on conversion of the $O_2$ within the air environment to CO as discussed above.

Hot gases, including reaction by-products CO and $CO_2$, plus minor and trace gases, dust and fume were extracted during the process via a fume hood 216 communicating with an exhaust gas-handling system.

During the reduction process, metallic reduction product reported in the liquid state as liquid metal beads, and as the individual beads grew in size and surface tension was overcome, the liquid metallic phase flowed to the base of the crucible 201 forming a pool 230 beneath a slag phase 231 of gangue products, which itself formed below the still reacting bed of reactant charge 232 until the depleting solids of the reactant charge bed 232 melted into the liquid slag phase 231. At this point, the microwave irradiation was ceased and the process terminated.

The reaction chamber 203 was then allowed to cool with the metal reaction product and slag phases solidifying enabling mechanical recovery. Passive, slow cooling beneath glowing char (to confer protection from oxidation) produced a "grey" alloy iron, whilst the alternative cooling process of cooling in water produced a "white" iron alloy.

To avoid oxidisation of the metallic product during cooling as the temperature within the crucible drops below the CO stability point of approximately 950° C. at which the CO would oxidise to the oxidising gas $CO_2$, a non-oxidising or inert gas can be introduced to the reaction chamber through the primary gas inlet 209 during cooling. Spectroscopic analyses and metallographic examination of the metallic reaction product identified a chromium iron alloy with a typical composition of approximately 65 at % Cr (and up to 76 at % Cr in minor iron beads), less than 4 at % C, and the balance principally Fe. The C intake increases with extended time at elevated temperature. All mineral matter was converted either to metal or slag, with only remnant char remaining above the slag phase.

EXAMPLE 4

This example details a process to reduce cassiterite ($SnO_2$) concentrate to extract metallic tin as product. Rather than being carried out in a fixed crucible within a static vessel or a modified microwave oven as per Examples 1 to 3, in this example the reduction process was carried out in a fluidised bed reactor, utilising a carbon monoxide/nitrogen plasma. The fluidised bed reactor configuration is depicted in FIGS. 5(*a*) to 5(*d*). The plasma reduction process can also be carried out in other established and hybrid reaction chamber configurations, including rotary kiln, cyclone, conveyor strand, screw and launder configurations, using the same basic process chemistry.

The process was conducted at blast-ambit "atmospheric" pressure high in the bed to higher pressures at the fluidising plate (between 200 kPa and 300 kPa) where initial reduction processing may be conducted via applied microwave energy supplied through the reactor base waveguide. Pressure drop through the fluidised bed is dictated by fluidisation dynamics of the reaction chamber and various parameters of the bed being fluidised itself, including the bed height, particle density, shape and size range. A non-equilibrium plasma was sustained along the full height of the reaction chamber column with the assistance of supplementary waveguides along the length of the reaction chamber, the application of which will be dependent upon mineral density, charge susceptibility to microwave radiation and applied power. With the pressure drop through the fluidised bed, the non-equilibrium plasma was more stable towards the top of the reaction chamber.

The current example carried out the reduction processing of a "low grade" cassiterite concentrate, containing approximately 60% Sn. Using, traditional reduction techniques for Sn, using reverberatory furnace smelters, grades below 65% Sn are undesired as it is not economically feasible to process tin product, with the ratio of "hardhead" (iron/tin phase) to recovered tin being too high. When iron is readily reduced with the tin producing the iron/tin hardhead phase, or the ratio of iron in the initial concentrate is high, the traditional reduction techniques are typically commercially untenable due to the excessive cost of extracting tin from the iron/tin hardhead phase. The ease of reduction of cassiterite concentrates increases with increasing tin content from low grade to high grade concentrates, with higher grade concentrates having been found to be more susceptible to microwave radiation than lower grade concentrates.

Fluidised bed reactors are commonly configured to carry out continuous processing operations, however the present process was carried out in a fluidised bed reactor configured for and operated as a batch process to enable tighter control over the cassiterite processing times within the reaction chamber. Such tighter control when processing cassiterite is desired to avoid over-processing of the cassiterite charge which would be detrimental to post processing operations. The continuous fluidised bed process is preferred, however, when less control is required on the reduction exposure to the applied electromagnetic radiation.

When the plasma process of the present example is utilised with either batch or continuous fluidised bed systems, the simultaneous reduction of gangue materials within the ore, particularly ferruginous minerals, is avoided. This consequently avoids the formation of contaminant phases (particularly hardhead, $FeSn_2$) within the reduction product and the associated restrictive cost penalties of re-processing such by-products in subsequent operations.

The fluidised bed reactor 300 of FIGS. 5(*a*) to 5(*d*) utilised in the present process comprises an elongated reaction chamber 301 formed of high temperature strength, corrosion resistant alloy steel. The reaction chamber 301 is insulated with a suitable refractory insulation wrap 302 to maintain heat within the reaction chamber. An air gap may be formed between the outer wall of the reaction chamber 301 and the insulation wrap 302 to isolate vibration and accommodate expansion.

A reactant charge inlet 303 is provided at the top of the reaction chamber 301 for charging the reaction chamber 301 with the particulate reaction charge. Referring to FIG. 5(*b*), a retractable, self sealing charging bell 304 is disposed within the reactant charge inlet 303. The charging bell 304 is rotatable and is provided with spiralling vanes 305 to assist in charge distribution within the reaction chamber 301. Other forms of device for charging the reaction chamber, such as a rotating chute, may alternatively be employed.

A perforated fluidising plate 306 is located at the base of the reaction chamber 301. A fluidising wind box 307 is located below, and opens onto, the fluidising plate 306. The fluidising wind box 307 communicates with a gas regeneration system (described below and depicted in FIG. 5(*c*)) upstream supplying gas to the wind box 307. The composition and pressure of blast gas supplied to the wind box 307 is controlled by a monitoring system 308.

An exhaust outlet 309 is located adjacent the charge inlet 303 at the top of the reaction chamber 301. The exhaust outlet 309 feeds a fume/solids product extraction system (not depicted) to separate fume and solids fines product from exhausted gases. This system then recycles cooled de-fumed gases into the chamber 310 of the gas regeneration system (see FIG. 5(*c*) via a recycle outlet 311. The chamber 310 is further provided with a fresh gas inlet 312 for introduction of gases from outside of the regeneration system, and a pressure relief valve and outlet 313 for the escape of gases under excess pressure.

A discharge chute 314 communicates with the reaction chamber 301 directly above the fluidising plate 306 for the discharging of batch process charges upon completion of processing of each batch. The chute 314 is closed during processing and communicates with a quenching chamber 315 for cooling/quenching of discharged material.

Top and bottom waveguides 316, 318 are located at the top of the reaction chamber 301 adjacent the reactant charge inlet 303 and at the bottom of the reaction chamber adjacent the fluidising plate 306 respectively. The top waveguide 316 is positioned to irradiate the top region of the reaction chamber, where off-take gases produced by reactions in the reaction chamber will be present. The bottom waveguide 318 is positioned to irradiate the bottom region of the reaction chamber above the fluidising plate 306. It is at this region that the reaction chamber pressure will be greatest. Further supplementary waveguides 317 were located around the periphery of the reaction chamber 301, spaced between the top and bottom, and about the circumference thereof (see FIG. 5(*d*)). The number, radiating frequency and arrangement of waveguides is dependent on the specific application, and in particular will depend on the reaction chamber configuration and the characteristics of the charge being processed. Microwave irradiation at 2450 MHz, total power variable up to 100 W per port, was utilised in the present example. The general location and orientation of the supplementary waveguides 317 depicted in FIG. 5(*d*) is preferred for multiple waveguides positioned along the reaction chamber 301. Rather than delivering the radiation utilising waveguides, coaxial cables or any other suitable delivery means could be employed.

In the process of the present example, the cassiterite concentrate was first prepared in particulate form with a grain size of less than 500 micrometers and in batches of close size ranges (+/−5% in grain diameter), which are preheated to 200° C. in preparation for charging into the reaction chamber 301.

Preheated air was then passed, via the wind box 307, through the fluidising plate 306 into the closed reaction chamber 301 and out through the exhaust gas outlet 309. Once the reaction chamber proper had reached approximately 250° C., the preheated air blast was replaced by an $N_2$/CO mixture (at an $N_2$:CO ratio of approximately 4:1) preheated to approximately 300° C. charged into the system from the fresh gas inlet 312 of the gas regeneration system. The CO gas was added to form the ionising reductant for the reduction of the cassiterite.

Whilst flushing the reaction chamber 301 with the $N_2$/CO mixture, the pre-heated cassiterite concentrate was charged into the reaction chamber 301 through the reactant charge inlet 303 until a full charge was achieved, and taking care during charging to adjust blast pressure of the $N_2$/CO mixture such that the incoming charge material did not sieve through the fluidising plate and that the fine charge material was not blasted out of the chamber with the exhaust gases. During charging, the charging bell 304 was manipulated to regulate and distribute the reactant charge, and in combination with regulation of the $N_2$/CO blast pressure passing upwards into the reaction chamber 301 through the fluidisation plate, fluidisation of the charge was established and maintained, whereby the fine charge was maintained in a turbulent suspension or "fluidised bed" 320. This fluidised bed of reactant particles maximises the reaction interface between the cassiterite charge and the gaseous CO reductant.

The fluidisation regime was established such that the fluid bed was sufficiently stable and dielectrically incoherent to allow penetration of microwave irradiation from the various waveguides 316, 317, 318.

To establish and maintain such a fluidisation regime which is stable and allows penetration of the radiation, the fluidising gas stream through the fluidising plate 306 should be incident at the bed base at such a pressure as to force the gas, lifting and fluidising the reactant charge bed, towards the zone of lower pressure at the bed stockline (top surface of the bed toward the top of the reaction chamber), where operating pressure should be as low as or close to atmospheric pressure as possible (in the absence of a vacuum evacuation system) so as to minimise the required fluidising pressure. The pressure drop between the fluidising plate 306 and the stockline (which should be minimised) is determined by the fluidisation dynamics of the bed in particular the particle size, density, size range, bed permeability and viscosities, and by the height of the bed. The fluidising pressure at the fluidising plate 306 is determined by providing the desired fluidising regime whilst minimising the top pressure at and above the bed stockline. This pressure at the fluidising plate 306 is controlled by the pressure sustained in the wind box 307. The wind box pressure must equate to the fluidising pressure plus the pressure drop across the fluidising plate 306, and was monitored and controlled by the gas re-generation system 310 and the feedback control system 308.

The process pressure range, of which the fluidisation pressure at the fluidisation plate will be the maximum, should be kept below 300 kPa to maintain the plasma within the non-equilibrium thermodynamic regime to maximise the processing benefits of highly energetic reactive particles, particularly those particles taking a direct role in the plasma reduction chemistry.

The reaction chamber was then irradiated with microwave radiation at 2450 MHz frequency via the waveguides, and the power adjusted until a stable nitrogen/carbon monoxide non-equilibrium plasma was formed to full charge height with predominant $CO^+$ reactive ions. The common 2450 MHz microwave frequency used for this and other examples described was found to be highly suited to the applications, and was used primarily out of convenience. Other frequencies within the range of 30 MHz to 300 GHz, radio frequency though microwave and into the "millimetre wavelength" frequencies have, however, been found to be variously well suited to the generation of non-equilibrium plasmas preferring an exploitable range of target mineral susceptibilities.

The fluidised cassiterite was reduced by the gaseous CO in the various states (ground, excited and ionised), to form Sn and $CO_2$. The plasma phase reduction can be represented by equation 4(*a*) below (where * represents a non-ground state re-combined particle or species):

$$SnO_2+2CO^++2e \Rightarrow Sn+2CO_2^* \quad 4(a)$$

Once the plasma chemistry was stabilised, fine carbon was injected through the fresh gas inlet 312 to mix with the fluidising blast gas ($N_2$/CO), such that CO was regenerated from the $CO_2$ generated during the gaseous phase reduction of cassiterite, thereby ensuring a continuing supply of $CO^+$ ions for the ongoing reduction of the cassiterite. This reaction, known as the Boudouard reaction, is represented by equation 4(b) below:

$$C+CO_2^* \Rightarrow 2CO \quad 4(b)$$

The Boudouard reaction is endothermic, and hence should only be employed when "temperature" moderation is appropriate. This reaction will also only proceed effectively at temperatures above about 940° C. Where, as a result of the above, the Boudouard reaction is not tenable, $CH_4$ can be utilised both as a reductant (both directly as methane or indirectly at temperatures above that at which methane decomposes to carbon plus hydrogen) to reduce the cassiterite ore and to regenerate CO for further reduction. Alternatively, $CH_4$ can be utilised both for regeneration of CO by reduction of $CO_2$ during the process and as a partial or total replacement for CO in the initial input gas mixture as initial reductant for the reduction of the cassiterite. Whilst the $CH_4$ itself does not ionise, dissociating (decomposing) at temperatures below 500° C. in the microwave field before it reaches its ionisation energy, the resultant hydrogen gas does form a plasma, as will the initial reduction product CO as soon as it is produced, acting as a reductant for subsequent plasma phase reduction. Further, fine carbon soot is produced as a by-product of the methane decomposition, which is ideal for re-generation of CO. Accordingly, even when CO is not used as an initial input gas, it is soon formed as a reduction by-product and/or through the Boudouard reaction breaking down $CO_2$ at high temperatures. The addition of methane to the fluidising gas can also be used to replace the addition of solid carbon fines to the fluidising gas discussed above to enable the CO-regenerating Boudouard reaction 4(b).

At the lower energy or "temperature" ranges of non-equilibrium plasmas, hydrogen is a less efficient reductant than carbon or carbon monoxide. Further, the Boudouard reaction, being endothermic, takes energy from the system in supplying CO. Accordingly, selecting $CH_4$ as initial gas input is a lower thermodynamic energy option in whose lower energy conditions "tramp elements", such as Fe, Mn, W and Si which may be contained in the ore reactant charge, will have lower probability of being reduced with the easier to reduce cassiterite, providing a more pure reduction product.

Furthermore utilising $CH_4$ introduces another gas to the system which results in a more complex off-take gas mixture requiring treatment and separation. The chemical reactions associated with the introduction of $CH_4$ can be represented by equations 4(c) to 4(g) below, plus the Boudouard equation 4(b).

$$CH_4 \Rightarrow C+2H_2 \quad 4(c)$$

$$SnO_2+2C \Rightarrow Sn+2CO \quad 4(d)$$

$$SnO_2+2CO \Rightarrow Sn+2CO_2 \quad 4(e)$$

$$2H_2 \Rightarrow 4H^++4e^- \quad 4(f)$$

$$SnO_2+4H^++4e^- \Rightarrow Sn+2H_2O \quad 4(g)$$

Additional chemical reactions of significance with respect to the gas mixture components in the reaction chamber atmosphere (with the addition of methane) can be represented by Equations 4(h) and 4(i) below:

$$2CO+CH_4 \Rightarrow 2C+2H_2O \quad 4(h)$$

$$N_2+CO_2+2CH_4 \Rightarrow 2C+2NH_3+CO+H_2O \quad 4(i)$$

These reactions are also of significance to the control of off-take gases, minimising negative environmental impact and the recovery of process by-products as materials of value. These reactions take place in the reaction chamber and, where desired, may be extended to completion in an augmentative chamber of the exhaust outlet 309. Because stoichiometry is preserved, Equations 4(h) and 4(i) have been generalised here in the ground state form for simplicity. Carbon monoxide and nitrogen will be ionised, whilst (if not already dissociated) methane will dissociate to soot plus hydrogen which will ionise. Also, other reactions and outcomes are possible but less stable, and thus unlikely.

During processing, off-take gases were exhausted through the exhaust outlet 309. The exhaust can then be drawn off to a cyclone to separate and remove entrained solid fumes from hot off-take gases bound for scrubbing or recycling (regeneration).

Reduction of the cassiterite produces tin (as indicated in equation 4(a)) in the form of micro liquid beads which form within the cassiterite particles and on the particle surfaces, where they are held tightly by the inherently high surface tension of liquid tin plus a film of higher melting point material being re-fused or reduction by-products of gangue minerals.

At a processing point determined by experience and an analysed mean of the accumulated data (charge vs time vs applied energy) with respect to degree of reduction of all prior process batches, microwave irradiation of the reaction chamber 301 was ceased. The particulate matter of the still fluid bed was then cooled to about 200° C. in a non-oxidising blast gas (nitrogen was used in this example) to solidify the tin. The solid contents of the bed were then discharged from the reaction chamber 301 through the discharge chute 314 into the quenching chamber 315 for further oxygen-free quenching (where required).

The metallic tin content can then be recovered from the quenched solids content by a suitable electrochemical or other recovery process. After recovery of the high purity tin, remaining incompletely reduced cassiterite or other mineral particulate material can be dried and returned for re-processing through the fluidised bed reactor in a subsequent charge blend. Any other fines remaining from the tin recovery process can be subjected to further extraction processes to extract any remaining high-value metallic content (or toxic content requiring separation and disposal) which may include metals such as Au, Ag, Th, RE's, Ta, W or Bi.

EXAMPLE 5

In the extractive reduction of comparable metal sulphides of the form $MS_2$, the "first" sulphur atom can be stripped by reduction with relative ease to yield the matte form, MS. Typically, in a second reduction stage, more intense pyrometallurgical operations are required to remove the remaining sulphur to produce the primary metal.

Figure 6:
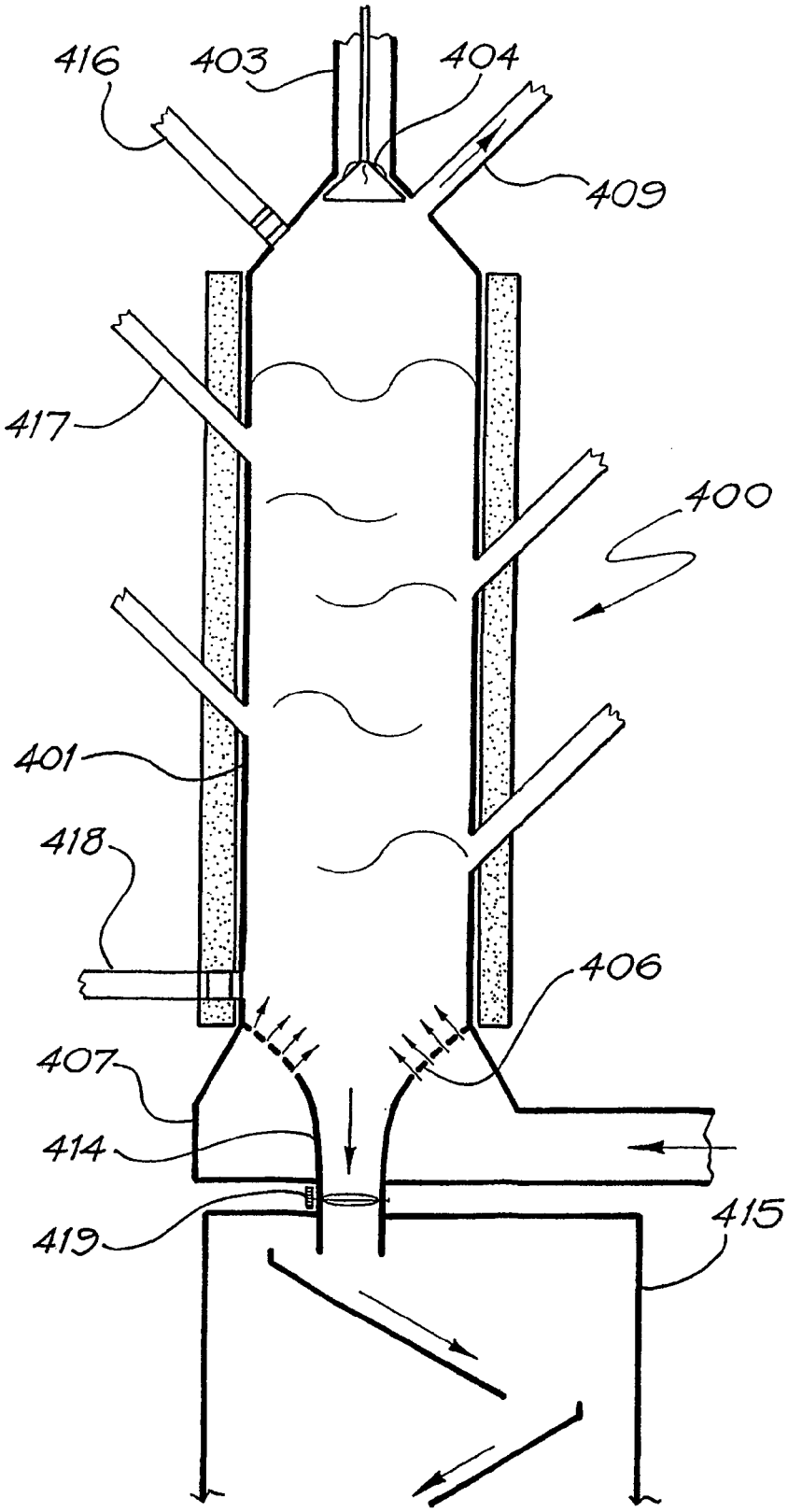
FIG. 6 is a partially cross sectioned view of a reaction chamber used in the process of Example 5.

This example details the reduction of molybdenite ($MoS_2$) ore concentrate in the solid state to yield a crude sponge molybdenum metal—apparently "sintered" by lower melting point phases (gangue and impurity metals). The reduction to metal was achieved in a continuous single stage operation which utilised the pneumatics of a plug flow fluidised reactor to moderate and balance the applied electromagnetic energy and equably stimulate reactions with an even distribution of energy through the descending column of charge material. The apparatus utilised to carry out the process is depicted in FIG. 6.

The plug flow fluidised bed reactor 400 utilised was configured for continuous processing. In such a reactor, blast gas is directed from a blast box 407 into the reaction chamber 401 though a perforated fluidising annulus 406 which takes the place of the fluidising plate of Example 3. In contrast to the batch configured reactor 300 of Example 3, reactant charge material is intermittently or continuously charged via the charging bell 404 (or a rotating chute equivalent), is fluidised by the ascending blast gas, the descending fluid bed obeying the mechanics of plug flow. The plug flow solids are subject to the reactions of the process to completeness, before being passed out of the reaction chamber 401 through the open discharge funnel 414 in the centre of the fluidising annulus 406 into a quenching chamber 415. Reactant charge material is continuously charged into the reaction chamber 401 and reaction product solids continuously discharged without closing down the reactor.

In the present example, the molybdenite ore concentrate was prepared in particulate form with a grain size of less than 200 micrometers, and blended with a solid reductant in the form of granular charcoal of size range 100 to 1200 micrometers in the stoichiometric ratio of 2:1 C:S. Selection of granular charcoal in this larger size range was imposed to provide better bed permeability given the plate-like morphology of molybdenite. The molybdenite/charcoal blend charge was then preheated to approximately 300° C. in preparation for charging into the reaction chamber 401.

At the beginning of the continuous process, preheated air was flushed through the reaction chamber 401 via the wind box 407 and fluidising annulus 406 into the reaction chamber 401 proper and out through the exhaust gas outlet 409. Once the reaction chamber temperature had reached approximately 300° C., the preheated blast air was replaced by a mixture of 10% CO in air which had been preheated to approximately 300° C., and, upon process start, increased to 600° C. at a rate of 10° C. per minute.

Whilst flushing the reaction chamber with the CO/air mixture at low blast pressure such that solid fines were not entrained and exhausted with the off-take gases, the preheated molybdenite/carbon charge blend was charged into the reaction chamber 401 (at the calculated rate of charging for the continuous operation) via the reactant charge inlet 403 and charging bell 404. An initial charge of the charge blend formed a temporary discharge funnel plug in the discharge funnel 414 between the closed discharge control valve 419 and the first charge of material above the fluidising annulus 406 subjected to full processing once a continuous plug flow had been initiated. Once continuous plug flow had been initiated, the discharge control valve 419 was opened. The first exiting unprocessed and under-processed material was removed from the quench chamber system and returned for blending with fresh blend material. Whilst the reaction chamber column was reaching full charge, and during the start-up stage, the newly fluidised bed was monitored so as to establish and preserve the plug flow regime which optimises full metallurgical conversion (by analysis) versus mean residence time (in the reaction chamber). The fluidised bed regime was established with sufficient fluid bed stability and dielectric incoherence to allow penetration of microwave radiation from the various waveguides 416, 417, 418 placed at the top, sides and base of the reaction chamber 401 in a similar manner to Example 3.

Reaction chamber top pressure (pressure above the bed stockline) should be as close to one atmosphere as is possible (given the pressure drop through the bed from the pressure at the base required to maintain the fluidisation regime), enabling the fluidisation pressure at the base of the reaction chamber to be maintained below the preferred 300 kPa is limit.

Although short wavelength electromagnetic frequencies in ranges above 12 GHz would have been preferred, as a result of the enhanced susceptibility of molybdenite at these frequencies indicated by results of mineral susceptibility vs irradiating frequency analyses, radiation at the common frequency of 2450 MHz was used out of availability and convenience (and found to be adequate for the purpose). Once the charge in the reaction chamber 401 had stabilised near the blast temperature of approximately 600°, the reaction chamber was irradiated with microwave radiation via the various waveguides 416, 417, 418. The power applied was adjusted until a stable plasma was formed with predominant $CO^+$ reactive ions in the nitrogen plasma. The $CO^+$ ions were formed following conversion of $O_2$ and $CO_2$ in the presence of charcoal, as the reaction chamber temperature increased beyond 950° C. as discussed in earlier Examples, with the reaction chamber "temperature" increasing to the ideal plasma reduction "temperature" of 1050° C. to 1100° C. (as measured by shielded thermocouple).

Whilst the exact reduction route achieved is not simple, the addition of small quantities of lime (CaO) to the reactant charge blend, or pelletised molybdenite/lime/brown coal paste dried pellets of close size range, here 1.5 mm±0.1 mm to 3.0 mm±0.2 mm, which were ideal for bed permeability and reduction chemistry with increased kinetics, had the effect of assisting reduction kinetics and reaction completeness.

Prominent reduction reactions which are understood to have occurred during processing are represented (without ionisation equivalents) in Equations 5(a) to 5(d). Equations 5(a) represents the initial stripping of the first sulphide atom from $MoS_2$ and the subsequent reduction to elemental molybdenum being represented by Equation 5(b):

$$MoS_2+O_2 \Rightarrow MoS+SO_2 \quad 5(a)$$

$$2MoS+C \Rightarrow Mo+CS_2 \quad 5(b)$$

$$CS_2+2O_2 \Rightarrow C+2SO_2 \quad 5(c)$$

Equations 5(d) and 5(e) represent the alternative route when lime is added:

$$MoS_2+2CaO \Rightarrow MoO_2+2CaS \quad 5(d)$$

$$MoO_2+2C \Rightarrow Mo+2CO \quad 5(e)$$

Once plasma chemistry has stabilised, fine carbon may be injected with the fluidising gas mix such that, where required, CO is regenerated from $O_2$ and $CO_2$ (generated during reduction) with the carbon high in the reaction chamber to confer the protection of a reducing atmosphere in a similar manner to Example 4. As discussed in relation to Example 4, The $CO_2$ reduction, the Boudouard reaction, is endothermic and the balance of reactions in the reactor can be manipulated such that reactor "temperature" profiles can be maintained as was the case for the earlier example.

Again in a similar manner to Example 4, $CH_4$ can be introduced both to regenerate CO and to provide an extra control mechanism (in addition to control of the applied electromagnetic radiation) by balancing the chemical energy released by exothermic reactions and that absorbed by endothermic reactions within the reaction chamber. The various reactions resulting from the addition of $CH_4$ are as per those of Equations 4(c), 4(b), 4(f), 4(h) and 4(i) discussed in relation to Example 4. It should be noted that whilst hydrogen increases its efficiency as a reductant in the higher operating temperatures of the present process, it does not eclipse carbon monoxide in reduction efficiency until much higher temperatures (above 2000° C.). Furthermore, the dissociation of methane to provide active hydrogen will result in the production of hydrogen sulphide ($H_2S$) gas which is normally a less desirable offtake gas option. The additional reduction reactions resulting from the generation of hydrogen ions through the addition of methane can be represented by Equations 5(f) and 5(g):

$$MoS_2+2H^+ \Rightarrow MoS+H_2S \quad 5(f)$$

$$MoS+2H^+ \Rightarrow Mo+H_2S \quad 5(g)$$

At the base of the reaction chamber 401, the loose, fluid product particulate solid of the descending bed was discharged through the discharge funnel 414. The rate of descent in the bed was controlled by the rate of discharge of processed solid material through the discharge funnel 414 which is governed by the setting of the discharge control valve 419. Reaction chamber residence time is dictated by rate of plug flow descent (of charge elements), which (given unhindered particulate fluidity) is controlled by the discharge rate, which is regulated by the discharge control valve setting. Residence time is determined by the thermochemical processing parameters (such as chemical availability, contact and reaction interface diffusion, chemical species, available energy and energy required) and the physical and chemical kinetics which determine the overall rate of chemical conversion, thence the time required for chemical conversion. The time required for chemical conversion should ideally be slightly less or equal to the designated residence time of reactant material in the reaction chamber.

The discharged material entered the quenching chamber 415 where it was kept mobile during cooling to minimise agglomeration of particles and to prevent bulk "sintering". The particulate solid product is in a form which can be easily managed and handled, and may be sent for further refining stage processing such as an arc or ion beam melt, zone refining operation.

As product was continuously discharged from the fluidised bed reaction chamber (column) 401, fresh charge blend material was continually charged onto the stockline of the fluidised bed in an even manner such that the stockline level remained constant.

EXAMPLE 6

Figure 7:
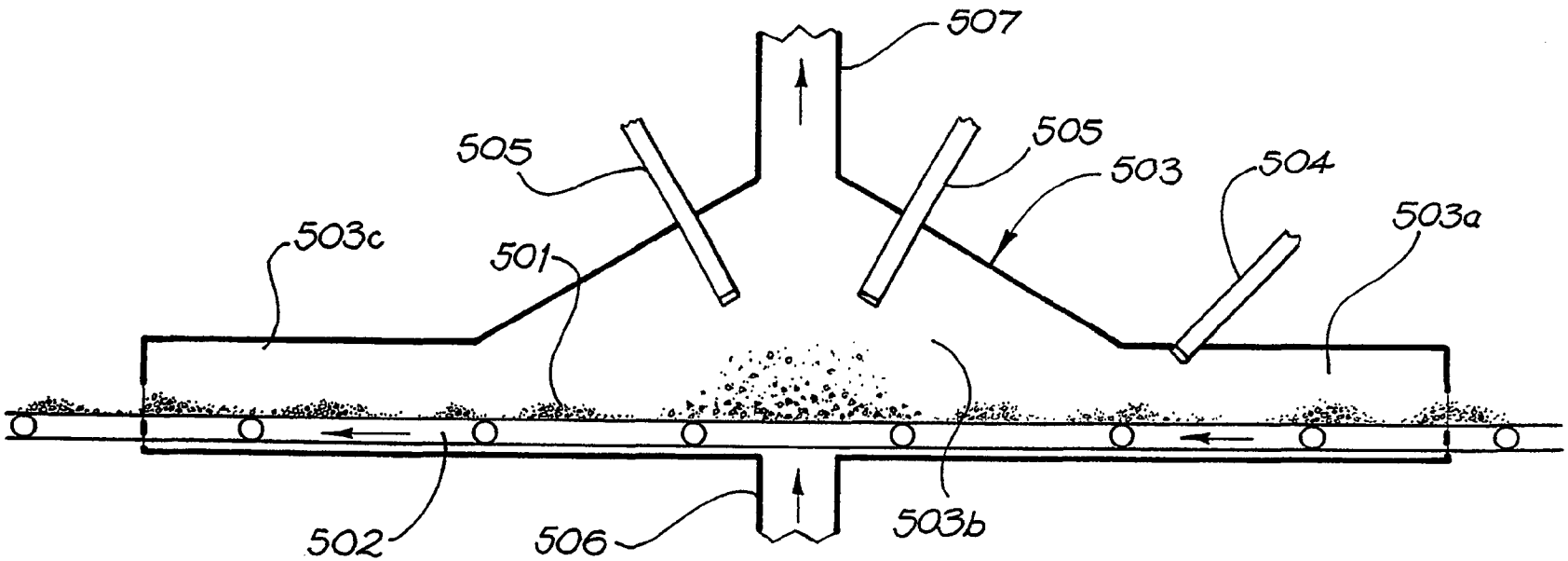
FIG. 7 is a partially cross sectioned view of a reaction chamber used in the process of Example 6.

This example details a process to reduce haematite ($Fe_2O_3$) using a conveyor to pass reactant charge material through an atmospheric pressure reaction chamber in a continuous process. The apparatus, termed a continuous conveyor fed reactor, utilised to carry out the process is depicted in FIG. 7.

Fine haematite was blended with a reductant in the form of fine brown coal char, the mixture was bound into a paste using brown coal slurry to result in an Fe:C ratio of approximately 2:3. The paste was agglomerated into pellets of approximately 3 millimetre diameter and dried until hard.

The dried pellets 501 were then evenly distributed across a sinter strand type conveyor 502 configured to allow blast gases to pass therethrough.

The pellets 501 on the conveyor 502 were then passed through the reaction chamber 503 of the continuous conveyor fed reactor. The reaction chamber 503 is configured with an inlet choke region 503*a* of restricted cross section, an open main chamber region 503*b* and an outlet choke region 503*c* of restricted cross-section. The dried pellets 501 were first irradiated with microwave radiation via a preliminary waveguide 504 in the inlet choke region 503*a* at a frequency of approximately 915 MHz, providing preliminary heating of the pellets. This preliminary heating may bring the haematite/char reactants to above 500° C., close to a temperature capable of initiating initial reduction reactions. As the heated pellets pass from the inlet choke region 503*a* towards the main open region 503*b* of the reaction chamber 503, they are irradiated with microwave radiation from central wave guides 505 at a frequency of 2450 MHz. In this central region, a hot air blast (at approximately 800° C.) is imparted on the pelletised reactant charge from a blast inlet 506 positioned directly beneath the conveyor 502 in the centre of the main chamber region 503*b*. The hot oxygen of the air passing through the carbon of the (now glowing red) hot reactants of the conveyor charge (at temperatures up to 1000° C.) rapidly converts to carbon monoxide. An $N_2$/CO plasma is sustained immediately above the charge in the region of the blast inlet 506, providing highly energetic reactive species in the primary reduction zone.

The reduction of haematite to elemental iron takes place through a series of reduction reactions which can be represented by Equations 6(a) to 6(g) below (without ionisation equivalents), general system pressure and temperature, and with respect to the local ionisation environment of the plasma zone, the reaction path depending upon the available energy of activation and the reaction mechanism, whether a solid state or gas phase reaction.

$$1.5Fe_2O_3+0.5C \Rightarrow Fe_3O_4+0.5CO \quad 6(a)$$

$$Fe_3O_4+C \Rightarrow 3FeO+CO \quad 6(b)$$

$$FeO+C \Rightarrow Fe+CO \quad 6(c)$$

$$1.5Fe_2O_3+0.5CO \Rightarrow Fe_3O_4+0.5CO_2 \quad 6(d)$$

$$Fe_3O_4+CO \Rightarrow 3FeO+CO_2 \quad 6(e)$$

$$FeO+CO \Rightarrow Fe+CO_2 \quad 6(f)$$

$$CO_2+C \Rightarrow 2CO \quad 6(g)$$

Offtake gases produced from the reactions are exhausted through the exhaust outlet 507 and treated for heat recovery or blast regeneration.

The CO plasma is positionally maintained in the centre of the reaction chamber as a result of the location of the hot air blast inlet 506 and the positioning of the main microwave radiation wave guides 505. The spongy solid reduced iron is subject to cooling as it travels from the plasma zone towards the outlet choke region 503*c*. As the iron cools below 950° C., nitrogen may be introduced to the atmosphere of the outlet choke region 503*c* to blanket the conveyor 502 and protect the reduced iron from re-oxidation which may result from free $O_2$ or from CO within the cooling chamber environment being converted to $CO_2$ at this lower temperature regime at which $CO_2$ exhibits stability.

EXAMPLE 7

Figure 8:
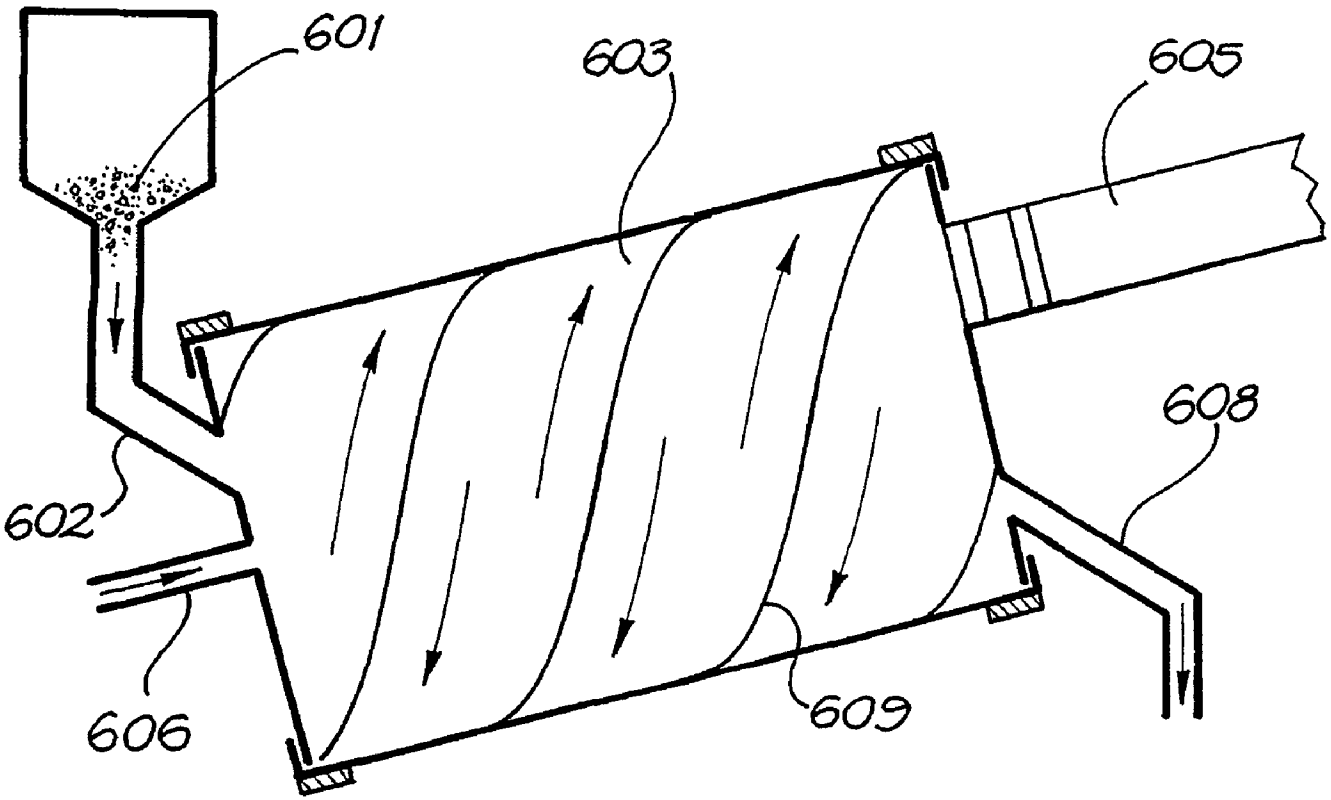
FIG. 8 is a partially cross sectioned view of a reaction chamber used in the process of Example 7.

This example details another process to reduce haematite to iron utilising a rotary kiln device using the same basic preparation and chemistry as Example 6. The apparatus utilised to carry out the process of this example is depicted in FIG. 8.

Haematite/carbon pellets 601 prepared in accordance with Example 6 were fed into the rotary kiln reaction chamber 603 via a reactant charge inlet 602. The reaction chamber 603 was charged via gas inlet 606 with a gas mixture of 10% CO in $N_2$ at low velocity, maintaining the pressure within the reaction chamber at approximately 1 atmosphere.

The 28 liter reaction chamber 603 was irradiated with microwave radiation at a power of approximately 1000 watt and frequency of 2450 MHz via a wave guide 605 positioned in a stationary end of the kiln, generating a $CO/N_2$ plasma throughout the central (16 to 20 liter) core volume (not occupied by the revolving charge nor spiral ribs 609) of the rotating reaction chamber 603.

The microwave radiation was moderated to prevent melting of the reactant charge, as detected and monitored by inspection of reduction product discharge which was drawn from the reaction chamber 603 via the discharge outlet 608. Both solid and gaseous phase products of the reaction product were drawn from the discharge outlet 608.

EXAMPLE 8

Figure 9A:
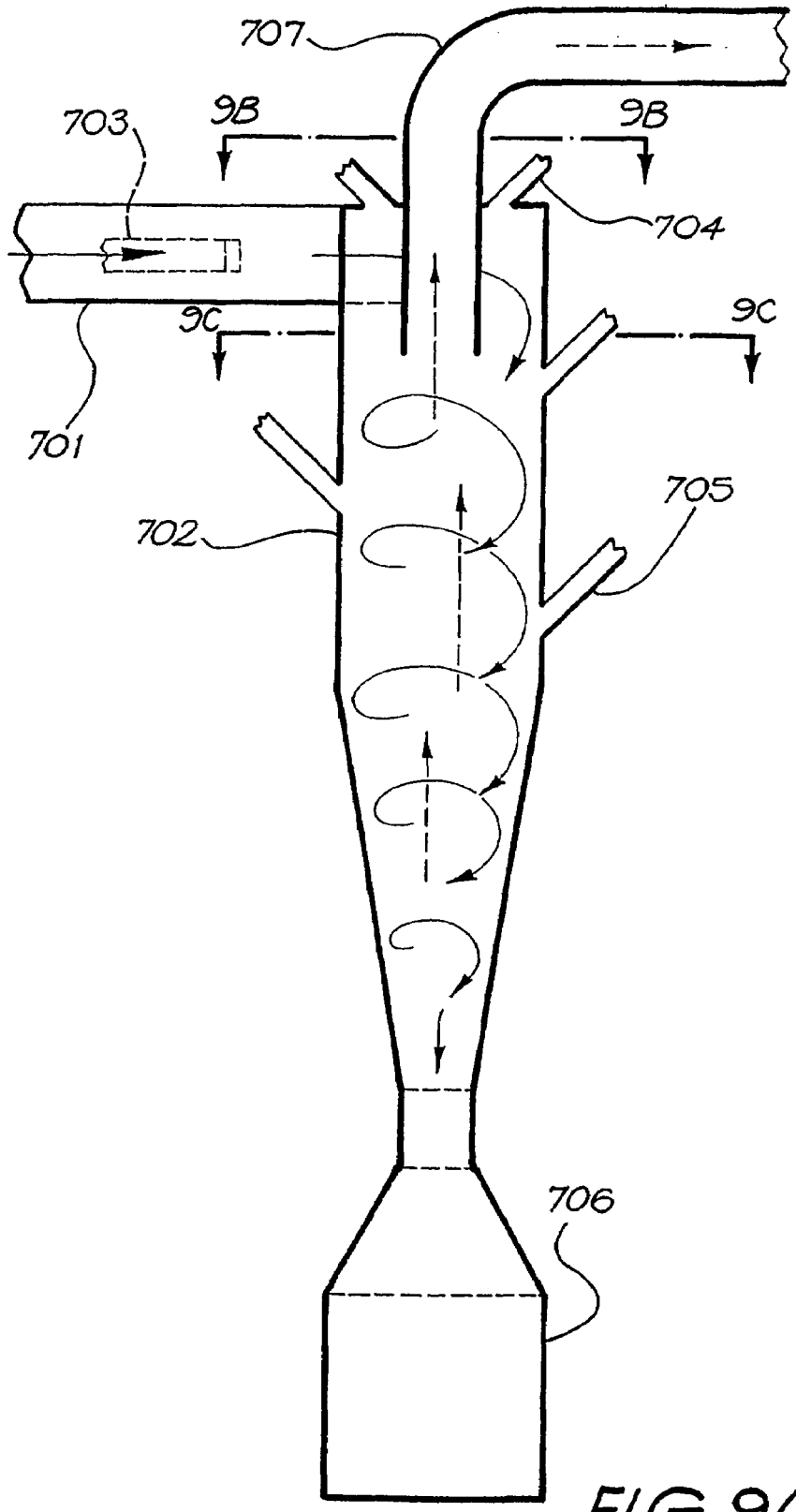
FIG. 9(*a*) is a cross sectioned view of a reaction chamber used in the process of Example 8.
Figure 9B:
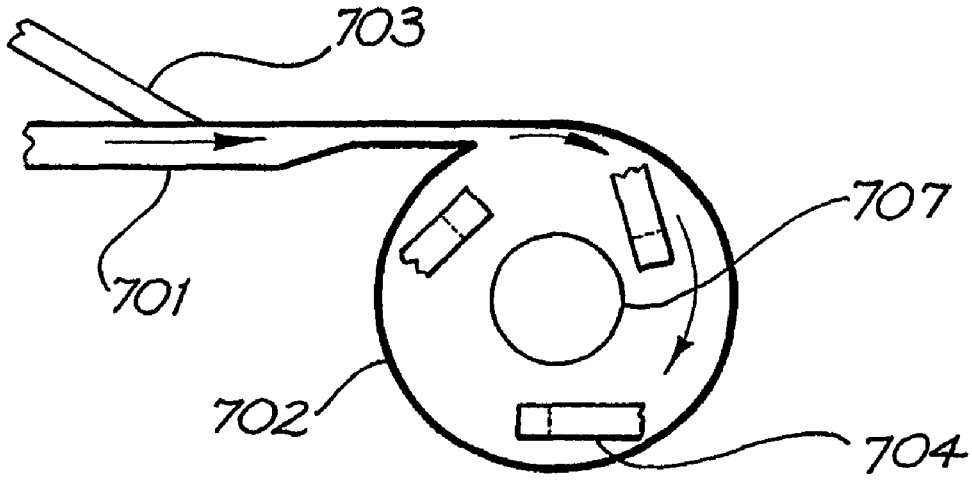
Figure 9C:
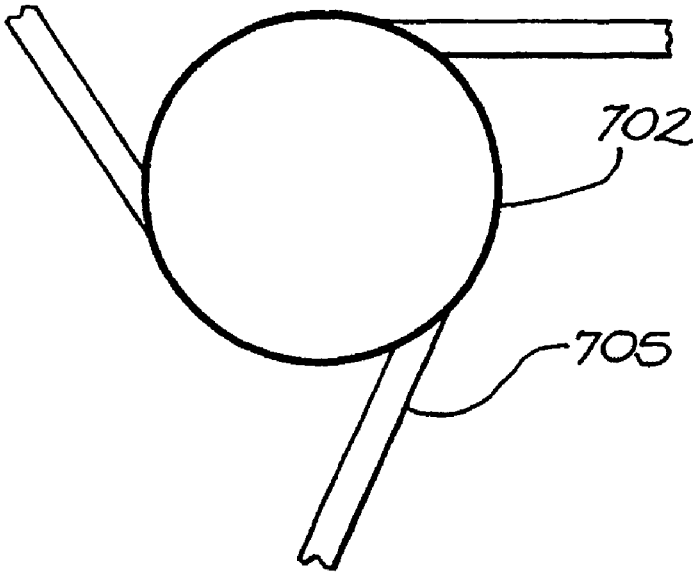

This example details a process to reduce haematite ($Fe_2O_3$) to low carbon iron (Fe) product, using a principally solid state reduction technique of in-flight entrainment of fine particulate charge material in a cyclone reactor. The apparatus utilised to carry out the process of this example is depicted in FIGS. 9(*a*) to 9(*c*).

Firstly haematite was prepared in a particulate form by milling to a grain size of less than 20 micrometers, and intimately blended with fine brown coal char milled to a grain size of less than 100 micrometers.

The reactant blend of haematite/char was then entrained with a blast stream of air preheated to in excess of 400° C. through a cyclone inlet 701 located at the top of the cyclone reaction chamber 702. The inlet 701 is arranged tangential to the cylindrical upper wall portion of the reaction chamber 702 such that the inlet blast air and entrained charged material follows a spiral path down through the reaction chamber 702.

The blast air and entrained reactant charge were irradiated with microwave radiation at a frequency of 2450 MHz via a primary waveguide 703 arranged to irradiate the air and reactant charge as it passed along the inlet 701 prior to entry into the reaction chamber 702 proper. The power of the microwave radiation applied was controlled to raise the blast air temperature to 1000° C. to ensure that free oxygen in the blast gases reacted with the fine char of the entrained charge blend converting $O_2$ through carbon dioxide ($CO_2$) to carbon monoxide (CO). The operating pressure range was kept below the preferred pressure maximum of 300 kPa, such that the $N_2/CO$ plasma formed beyond the port and in the cyclone reaction chamber was in the upper range of non-equilibrium conditions, raising the air to an appropriate temperature to ensure that remaining free oxygen ($O_2$) and carbon dioxide ($CO_2$) in the blast air reacted with the fine char of the reactant charge blend to convert them to carbon monoxide (CO).

The reactant charge and blast air were further irradiated by further primary microwave waveguides 704 at the top of the reaction chamber 702, positioned around the circumference of the reaction chamber 702 as indicated in FIG. 9(*b*).

Whilst the 2450 MHz frequency utilised in the present example was found to be effective and efficient in the present example, frequencies in excess of 12 GHz were found to be preferable for this specific application.

In the non-equilibrium $N_2/CO$ plasma environment toward the top of the reaction chamber, the haematite was reduced to magnetite, Fe3O4, utilising the highly energetic, reactive $CO^+$ ions for primary reduction stimulation. The magnetite was subsequently reduced to the most thermodynamically stable of the iron oxide phases, wustite, FeO, which was subsequently reduced to metallic iron. Any liquid phase formation from exothermic reactions was avoided by the in-flight cooling dynamics within the reaction chamber. The reduced product had the appearance of solid state reduction rather than re-solidification of a reduced liquid phase. Any tendency to $CO_2$ generation during the sequence of reduction was countered by Boudouard gasification between remaining entrained char and $CO_2$ to re-generate CO (as per Equation 6(g)) in reaction chamber 702.

This CO regeneration process was assisted through the addition of further fine free carbon via the cyclone inlet 701. The CO produced from the $CO_2$ can be utilised for further reduction in the various stages of the haematite reduction to iron, and also provides protection against oxidation of the elemental iron product.

The reactions of generating and re-generating CO are endothermic, and accordingly further external energy was required to maintain the temperature within the reaction chamber. This energy was applied through supplementary microwave waveguides 705 positioned around the circumference of the reaction chamber 702 and spaced therealong.

A typical circumferentially spaced pattern of supplementary waveguides 705 is depicted in FIG. 9(*c*). The supplementary waveguides 705 also provided the energy required for the final reduction stage of the FeO to metallic iron, which required considerably more is energy than the initial reduction stages.

The reduced iron particles cooled as the spiral path passed into the lower tapered portion of the reaction chamber 702 below the effect of the various waveguides, and as a result of the mass of the iron particles disengaged from the entrained flow and dropped into a collection chamber 706 at the base of the reaction chamber 702. The collection chamber was blanketed with CO (or alternately inert gas) to protect the reduced iron from oxidation. The solid iron product retrieved from the collection chamber 706 was in the form of high carbon steel powder, which was relatively low in carbon (0.3 wt % to 1 wt % compared to iron).

Off-take gases from the various reactions were extracted from the exhaust gas outlet 707 located in the centre of the top of the reaction chamber 702, and diverted to appropriate gas handling systems (baghouse, scrubbing, gas regeneration as appropriate).

The off-take gases primarily consisted of $N_2$, CO and $CO_2$.

The person skilled in the art will appreciate the manner in which the various forms of reaction can be applied utilising the radiation stimulated plasma of the present invention.

The invention claimed is:

1. A process for the reduction of a metalliferous ore or concentrate comprising the steps of:

preparing said ore or concentrate into a particulate form;

charging a reaction chamber with said ore or concentrate, a reductant and an input gas;

irradiating said reaction chamber with electromagnetic radiation within a frequency range of 30 MHz to 300 GHz until a non-equilibrium plasma is initiated, and sustaining and controlling said non-equilibrium plasma with said radiation until said ore or concentrate is reduced to form reduction product;

wherein pressure within said reaction chamber is maintained above 40 kPa and below 300 kPa during irradiation thereof; and further wherein said reductant comprises a carbonaceous material.

2. The process of claim 1 wherein said pressure is maintained at about atmospheric pressure.

3. The process of claim 1 wherein said plasma is initiated in said input gas.

4. The process of claim 1 wherein at least part of said input gas is decomposed during said irradiation, said plasma being initiated at least in part in the decomposed product of said input gas.

5. The process of claim 1 wherein said reductant includes a particulate carbonaceous material blended with said ore or concentrate.

6. The process of claim 1 wherein said reductant includes carbon monoxide gas, said input gas including said carbon monoxide gas, said plasma being initiated at least in part in said carbon monoxide gas.

7. The process of claim 1 wherein said reductant comprises carbon monoxide gas and a particulate carbonaceous material.

8. The process of claim 1 wherein said reductant comprises a reactive metal.

9. The process of claim 1 wherein said input gas includes an inert gas.

10. The process of claim 9 wherein said inert gas comprises argon or nitrogen.

11. The process of claim 1 wherein said input gas comprises air.

12. The process of claim 1 wherein said reductant includes methane.

13. The process of claim 1 wherein said radiation is microwave radiation.

14. The process of claim 1 wherein said ore or concentrate is a concentrate derived directly from mined ore.

15. The process of claim 1 wherein said ore or concentrate is a non-ore derived concentrate.

16. The process of claim 1 wherein said ore or concentrate is a concentrate in the form of a residue derived from metallurgical processing operations.

17. The process of claim 1 wherein said reaction chamber is in the form of a fluidised bed reactor.

18. The process of claim 1 wherein said reaction chamber is in the form of an oven, said ore or concentrate being charged into a crucible placed within said oven.

19. The process of claim 1 wherein said reaction chamber is in the form of a rotary kiln reactor.

20. The process of claim 1 wherein said reaction chamber is in the form of a cyclone reactor.

21. The process of claim 1 wherein said reaction chamber is in the form of a conveyor fed reaction.

22. The process of claim 21 wherein said ore or concentrate is prepared into a pelletised particulate form.

23. The process of claim 1 wherein said reduction product is of metallic form.

24. The process of claim 23 wherein said metallic reduction product is in the form of a fume, said fume being extracted from said reaction chamber and separated from gases produced during said reduction.

25. The process of claim 1 wherein said reduction product is a compound of reduced oxidation state.

26. The process of claim 1 wherein said reduction product is formed by reduction of said ore or concentrate through a series of subsequent reduction reactions.

27. The process of claim 1 wherein said process includes the step of generating carbon monoxide, said plasma being initiated and sustained at least in part in said carbon monoxide.

28. The process of claim 27 wherein said input gas includes air, said reductant includes particulate carbonaceous material and said carbon monoxide is generated from reaction of oxygen within said air with said particulate carbonaceous material.

29. The process of claim 27 wherein said reductant includes particulate carbonaceous material and said carbon monoxide is generated from reaction of carbon dioxide produced during said reduction with said particulate carbonaceous material.

30. The process of claim 27 wherein particulate carbonaceous material is introduced into said reaction chamber after initiation of said plasma, said carbon monoxide being generated from reaction of carbon dioxide produced during said reduction, with said introduced particulate carbonaceous material.

31. The process of claim 27 wherein said input gas includes air and particulate carbonaceous material is introduced into said reaction chamber after initiation of said plasma, said carbon monoxide being generated from reaction of oxygen within said air with said introduced particulate carbonaceous material.

32. The process of claim 1 wherein said ore or concentrate is enveloped in a non-oxidising or inert gas environment during said reduction and during cooling of said reduction product following irradiation of said reaction chamber.

33. The process of claim 32 wherein said non-oxidising or inert gas is introduced to said reaction chamber during said cooling.

34. The process of claim 1 wherein said input gas is passed through said ore or concentrate during said irradiating step.

35. The process of claim 34 wherein said input gas is blasted upwardly through said ore or concentrate.

36. The process of claim 1 wherein said input gas is preheated prior to charging into said reaction chamber.

* * * * *